US010698329B2

(12) United States Patent
Kadonome et al.

(10) Patent No.: US 10,698,329 B2
(45) Date of Patent: Jun. 30, 2020

(54) ELECTROSTATIC IMAGE DEVELOPER

(71) Applicant: Konica Minolta, Inc., Tokyo (JP)

(72) Inventors: Futoshi Kadonome, Sagamihara (JP); Keiji Arai, Higashimurayama (JP); Junichi Furukawa, Hino (JP); Ikuko Sakurada, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/399,408

(22) Filed: Apr. 30, 2019

(65) Prior Publication Data

US 2019/0384201 A1 Dec. 19, 2019

(51) Int. Cl.

| | |
|---|---|
| ***G03G 9/113*** | (2006.01) |
| ***G03G 9/097*** | (2006.01) |
| ***G03G 9/08*** | (2006.01) |
| ***G03G 9/087*** | (2006.01) |

(52) U.S. Cl.

CPC ..... *G03G 9/09716* (2013.01); *G03G 9/0819* (2013.01); *G03G 9/08711* (2013.01); *G03G 9/08755* (2013.01); *G03G 9/09708* (2013.01); *G03G 9/1131* (2013.01); *G03G 9/1133* (2013.01); *G03G 9/1139* (2013.01)

(58) Field of Classification Search

CPC ..... G03G 9/113; G03G 9/1139

See application file for complete search history.

(56) References Cited

U.S. PATENT DOCUMENTS

| | | | | |
|---|---|---|---|---|
| 9,523,932 | B2 * | 12/2016 | Srinivasan | G03G 9/0817 |
| 2011/0236813 | A1 * | 9/2011 | Kiyono | G03G 21/1814 430/105 |
| 2016/0139524 | A1 * | 5/2016 | Okita | G03G 9/09371 430/109.4 |
| 2016/0363880 | A1 * | 12/2016 | Takii | G03G 9/1139 |

FOREIGN PATENT DOCUMENTS

| | | | |
|---|---|---|---|
| JP | 2010-150277 | A | 7/2010 |
| JP | 2017-068006 | A | 4/2017 |
| JP | 2017-219118 | A | 12/2017 |

* cited by examiner

*Primary Examiner* — Peter L Vajda

(74) *Attorney, Agent, or Firm* — Lucas & Mercanti, LLP

(57) ABSTRACT

Provided is an electrostatic charge image developer containing toner particles and carrier particles, wherein the toner particles contain at least silica particles or alumina particles as an external additive; the carrier particles contain core material particles and a coating resin layer covering a surface of the core particles; the coating resin layer contains metal oxide particles; an element measured by XPS (photoelectron spectroscopy) of the carrier particle is at least Si or Al; and a content of Si or Al in the carrier particle is in the range of 1 to 6 at % with respect to the total elements constituting the carrier particles.

4 Claims, 1 Drawing Sheet

ELECTROSTATIC IMAGE DEVELOPER

Japanese Patent Application No. 2018-113538, filed on Jun. 14, 2018 with Japan Patent Office, is incorporated herein by reference in its entirety.

TECHNOLOGICAL FIELD

The present invention relates to an electrostatic image developer. More particularly, the present invention relates to an electrostatic image developer that is substantially free from titanium oxide, is capable of stabilizing the charge amount for a long period of time, and is excellent in the quality of an image to be formed.

DESCRIPTION OF THE RELATED ART

In recent years, from the viewpoint of improving fixability, an electrostatic charge image developer (hereinafter also simply referred to as "a developer") comprising a toner and a carrier using a crystalline resin has been developed, and it is required to be able to output a stable image over a long period of time. As a technology for stabilizing the charge amount, there are various approaches such as external additives and carriers. As an external additive, there is a technique for achieving durability and charge stabilization in a use environment by using titanium oxide (see, for example, Patent Document 1: JP-A 2017-219118 and Patent Document 2: JP-A 2017-68006). Titanium oxide has a low resistance compared with external additives such as silica and alumina, and it is widely used for the purpose of suppressing excessive charging at low temperature and low humidity (reduction of environmental difference of charge amount).

However, titanium oxide is sometimes mentioned as an object of environmental regulation, and alternative technologies are currently required. In the case where titanium oxide is not substantially used in the developer, when printing is performed as described above, and when the toner is replaced and replenished to the developer, the charge amount of the toner in the developer excessively increases. As a result, problems such as deterioration of the cleaning property of the toner, deterioration of developability and transferability occur. Especially fluctuation becomes large when the developer is relatively new or in a low temperature and low humidity environment (LL environment).

Therefore, it is conceivable to lower the chargeability of the toner from the carrier side. As such a technique, a technique for lowering the resistance of the carrier itself by adding a low resistance material (carbon black, alumina, or magnesium oxide) to the carrier, thereby suppressing excessive charge is disclosed (for example, Patent Document 3: JP-A 2010-150277).

However, in long-term durability, when the film thickness of the carrier decreases, the charge imparting ability of the carrier decreases. As a result, an image failure such as reduction in graininess (GI value) or fogging is induced. In particular, with the toner containing the crystalline resin, this image failure is remarkable because the resistance of the crystalline resin is low.

SUMMARY

The present invention has been made in view of the above problems and circumstances. An object of the present invention is to provide an electrostatic charge image developer substantially without containing titanium oxide. This developer is capable of stabilizing the charge amount for a long period of time and is excellent in the quality of the formed image.

In order to solve the above problems, the inventors of the present invention have examined the causes of the above-mentioned problems and found the following. By adding oxide particles (silica or alumina) which is an external additive of toner to the carrier particles and setting the content of Si or Al measured by XPS within the specific range as the surface existing amount on the carrier particles, it is possible to provide an electrostatic charge image developer which is capable of securing long-term charging stability and is excellent in the quality of an image to be formed without containing titanium oxide. Thus the present invention has been achieved. That is, the problem according to the present invention is solved by the following means.

An electrostatic charge image developer that reflects one aspect of the present invention is an electrostatic charge image developer comprising toner particles and carrier particles, wherein the toner particles contain at least silica particles or alumina particles as an external additive; the carrier particles contain core material particles and a coating resin layer covering a surface of the core particles; the coating resin layer contains metal oxide particles; an element measured by XPS (photoelectron spectroscopy) of the carrier particle is at least Si or Al; and a content of Si or Al in the carrier particle is in the range of 1 to 6 at % with respect to the total elements constituting the carrier particles.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
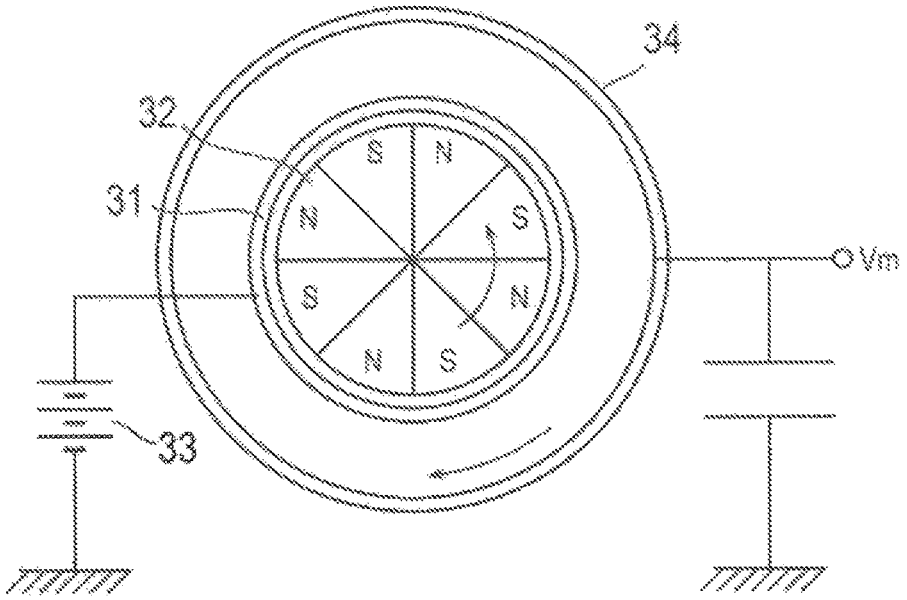
FIG. 1 is a schematic diagram of an apparatus for separating and recovering carriers in an electrostatic charge image developer.

Hereinafter, one or more embodiments of the present invention will be described with reference to the drawings. However, the scope of the invention is not limited to the disclosed embodiments.

According to the above means of the present invention, it is possible to provide an electrostatic charge image developer which can stabilize the charge amount for a long period and is excellent in the quality of the formed image substantially without containing titanium oxide. Although an appearing mechanism or an action mechanism of the effect of the present invention is not clarified, it is presumed as follows.

From the viewpoint of imparting fluidity and imparting negative chargeability, silica particles or alumina particles are added as an external additive to the toner. As the carrier particles, metal oxide particles (silica particles or alumina particles) are present in the coating resin layer, thereby it is possible to form a state in which the external additive is transferred to a surface of the carrier particle in a simulated manner. This is presumably because silica particles or alumina particles present on the surface of the toner particles and silica particles or alumina particles present on the surface of the carrier particles have the same composition, the difference in charging order is small, and triboelectric charging is suppressed. In addition, since silica or alumina has higher resistance than titanium oxide or carbon black which is a conventional additive, leakage of electric charge can be suppressed even at the end of endurance even when the film thickness of the carrier is decreased, and it is possible to suppress a decrease in charge amount. The charge amount of the toner in the developer largely depends on friction mixing with the carrier. When the content of Si or Al present on the surface of the carrier is 1 at % or more, the content of Si or Al present is sufficient and triboelectric charging may be prevented from becoming excessive. When the content of Si or Al present on the surface of the carrier is 6 at % or less, it is possible to prevent reduction in the charge amount at the end of endurance or in a high temperature and high humidity environment without lowering the chargeability on the carrier side.

An electrostatic charge image developer of the present invention comprises toner particles and carrier particles, wherein the toner particles contain at least silica particles or alumina particles as an external additive; the carrier particles contain core material particles and a coating resin layer covering a surface of the core particles; the coating resin layer contains metal oxide particles; an element measured by XPS (photoelectron spectroscopy) of the carrier particle is at least Si or Al; and a content of Si or Al in the carrier particle is in the range of 1 to 6 at % with respect to the total elements constituting the carrier particles. This feature is a technical feature common or corresponding to the following embodiments.

In an embodiment of the present invention, it is preferable that the toner particles contain a crystalline resin. By containing a crystalline resin, low resistance is obtained as toner particles, and the charge holding ability is lowered. However, as described above, the charge amount stability is improved by the combination of the carrier particles and the external additive particles of the present constitution. In particular, it is preferable that the crystalline resin forms a domain-matrix structure in the toner mother particles. It is excellent not only in low-temperature fixability. It is preferable in terms of being able to reduce bias of the charge of the toner mother particles and make it uniform by being able to disperse the crystalline resin in the toner mother particles.

Silica particles or alumina particles are used as the external additive contained in the toner particles from the viewpoint of maintaining the negative chargeability of the toner. Therefore, as the metal oxide particles contained in the carrier, those having the same composition as the surface of the toner particle are preferable. At the end of the life of the developer, the film thickness of the carrier decreases, and the charge imparting ability on the carrier side may decrease. Therefore, it is preferable that the charge amount may be easily maintained on the toner side and charge is easily held even on the carrier side, and silica particles with relatively high resistance are particularly preferable.

The present invention and the constitution elements thereof, as well as configurations and embodiments, will be detailed in the following. In the present description, when two figures are used to indicate a range of value before and after "to", these figures are included in the range as a lowest limit value and an upper limit value.

[Outline of Electrostatic Charge Image Developer of the Present Invention]

An electrostatic charge image developer of the present invention comprises toner particles and carrier particles, wherein the toner particles contain at least silica particles or alumina particles as an external additive; the carrier particles contain core material particles and a coating resin layer covering a surface of the core particles; the coating resin layer contains metal oxide particles; an element measured by XPS (photoelectron spectroscopy) of the carrier particle is at least Si or Al; and a content of Si or Al in the carrier particle is in the range of 1 to 6 at % with respect to the total elements constituting the carrier particles. In the present invention, the phrase "substantially without containing titanium oxide" indicates that titanium oxide particles may be contained as an external additive as long as the requirements of the present invention are satisfied and the effect of the present invention is not impaired, but this phrase does not include an amount that affects the environment.

<Content of Si or Al on Carrier Particle Surface>

In the developer of the present invention, the element measured by XPS (photoelectron spectroscopy) of the carrier particle is at least Si or Al. And a content of Si or Al in the carrier particle is in the range of 1 to 6 at %, more preferably in the range of 2.0 to 4.0 at % with respect to the total elements constituting the carrier particles. That is, in the developer of the present invention, at least silica particles or alumina particles are contained in the coating resin layer which is the surface of the carrier particles, and the amount of at least Si or Al element measured by the XPS is in the range of 1 to 6 at %.

The content of Si or Al element measured by XPS is not contained within the above range as a result of the toner external additive adhering to the surface of the carrier particles, while the developer is used for a long time. In the present invention, it means that at least silica particles or alumina particles are contained in the coating resin layer constituting the carrier particles beforehand so as to fall within the above range.

As a means for adjusting the content of Si or Al in the range of 1 to 6 at %, it is preferable to control the addition amount of silica particles and alumina particles. When silica particles are used alone, the preferable range of the addition amount is in the range of 0.5 to 2.5 mass parts with respect to the coating resin covering the surface of the core material particles of the carrier particles. When alumina particles are used alone, the preferable range of the addition amount is in the range of 0.8 to 4.0 mass parts with respect to the coating resin covering the surface of the core material particles of the carrier particles. On the other hand, when silica particles and alumina particles are used in combination, they are used in combination within the range when used alone, and the effect of the present invention is exhibited by setting the total element amount of Si and Al in the range of 1 to 6 at %.

The content of Si or Al on the surface of the carrier particles may be determined as follows. After separating and recovering the carrier by the method of separating the carrier from the developer, it is obtained by the method described in "Measurement of content (at %) of Si or Al on carrier particle surface by XPS" described below.

(Method of Separating Carrier from Developer)

The separation and recovery of the carrier in the developer of the present invention is performed using the apparatus illustrated in FIG. 1. First, 1 g of the developer measured by a precision balance is placed on the entire surface of a conductive sleeve 31 so as to be uniform. While supplying a voltage of 3 kV from a bias power supply 33 to the sleeve 31, the number of revolutions of a magnet roll 32 provided in the conductive sleeve 31 is set to 2000 rpm. In this state, it is left for 60 seconds to collect the toner on a cylindrical electrode 34. By collecting the carrier remaining on the sleeve 31 after 60 seconds, it is possible to separate the toner from the developer and obtain the carrier.

(Measurement of Content of Si or Al (at %) on Carrier Particle Surface by XPS)

By using a measuring device: an XPS analyzer K-α manufactured by Thermo Fisher Scientific; and under measuring conditions: elements C, Si, Ti, Al, O, Zn, Fe, Mn, Mg to be measured, a surface element analysis is performed under the following conditions. In the measurement of XPS, the sample is introduced into the measurement chamber, and after the vacuum level of the measurement chamber reaches $9.0\times10^{-8}$ mbar, the X-ray is started to perform measurement. Thus, the concentrations of Si and Al elements (the amounts of Si and Al on the surface of carrier particles of the developer) measured by XPS can be determined.

Spot diameter: 400 μm

Scan count: 15 times

PASS Energy: 50 eV

Analysis method: Smart method

[Toner Particles]

The toner particles according to the present invention have an external additive on the surface of the toner mother particles and contain silica particles or alumina particles as an external additive.

In the present invention, a toner mother particle to which an external additive is added is called a toner particle, and an aggregate of toner particles is called a toner. In general, the toner mother particles may be used as it is, but in the present invention, toner mother particles to which an external additive is added are used as toner particles.

<External Additive>

The external additive according to the present invention is added (externally added) to the surface of toner mother particles, and contains silica particles or alumina particles. In the present invention, it is preferable to use silica particles and alumina particles in combination.

It is preferable that the surface of the silica particles or alumina particles contained as the external additive is surface treated (hydrophobicized) with a surface treatment agent (hydrophobization agent). This is because the surface treatment makes it difficult to adsorb water, and the decrease in the charge amount can be more effectively suppressed. A well-known surface treatment agent is used for the said surface treatment. Examples of the surface treatment agent include silane coupling agents, titanate coupling agents, aluminate coupling agents, fatty acids, metal salts of fatty acids, esterified compounds thereof, rosin acids, and silicone oils.

(Particle Diameter of Silica Particles or Alumina Particles (External Additive Particles) on Toner Surface)

The number average particle diameter of the silica particles or alumina particles added to and contained in the toner surface is preferably in the same range of 10 to 50 μm as the silica particles or alumina particles contained in the carrier surface described above. This is because by using silica particles or alumina particles having the same particle size as the carrier side, even if silica particles or alumina particles migrate between the carrier and the toner during long-term usage, it is possible to suppress changes in the charge amount. When the number average particle diameter of the silica particles or the alumina particles is 50 μm or less, it is possible to prevent the silica particles or the alumina particles added to the toner surface from migrating to the carrier side. In addition, when the number average particle diameter is 10 μm or more, it is possible to prevent the formation of aggregates instead of disintegration of silica particles or alumina particles themselves during external addition treatment. Also in this case, it is possible to prevent the migration of the silica particles or alumina particles to be added to the toner surface to the carrier side. From the above viewpoint, the number average particle diameter of the silica particles or alumina particles added to the toner surface preferably is in the range of 10 to 50 μm. More preferably, it is in the range of 10 to 20 μm.

The number average particle diameter of such silica particles or alumina particles (external additive particles) may be adjusted, for example, by classification or mixing of classified products.

(Measurement of Particle Diameter of Silica Particles or Alumina Particles (External Additive Particles) on Toner Surface)

The number average particle diameter of silica particles on the toner surface is measured as follows. An SEM image magnified 50,000 times is captured with a scanner by using a scanning electron microscope (SEM) "JSM-7401F" (manufactured by JEOL Ltd.) and the silica particles on the toner surface in the SEM photograph image are binarized with an image analyzer LUZEX AP (manufactured by NIRECO CORPORATION). The horizontal Feret diameters of 100 silica particles on the toner surface are calculated, and the average is defined as the number average particle diameter. The alumina particles can also be measured in the same manner.

The silica particles or alumina particles to be added to the toner surface may be known ones. As a method of producing silica particles or alumina particles to be added to the toner surface of the present invention, a gas phase method is preferable.

Since the silica particles or alumina particles produced by the gas phase method have a shape with a low degree of sphericity, they may be contacted at a plurality of points instead of one point when the toner is externally added to contain the silica particles or alumina particles. Therefore, it is preferable that the silica particles or alumina particles are hardly detached from the toner and they are prevented from transferring to the carrier side.

The production method by the gas phase method is a method of introducing a raw material of silica particles or alumina particles into a high temperature flame in a vapor state or powder state and oxidizing them to produce silica particles or alumina particles. As a raw material of silica particles, silicon halides such as silicon tetrachloride, or organosilicon compounds are mentioned. Aluminum trichloride is mainly used as a raw material of alumina particles (see, for example, paragraph [0053] of JP-A 2012-224542).

Moreover, about the description of the specific method which produces silica particles or an alumina particles by the vapor phase method with a vapor, it is the same as described for the silica particles or the alumina particles contained on the carrier surface mentioned later. Therefore, the explanation here is omitted.

The detailed description of the hydrophobization treatment of the silica particles or the alumina particles is also the same as that described for the silica particles or the alumina particles to be contained in the carrier surface described later. Therefore, the explanation here is omitted.

In addition to the above-mentioned silica particles or alumina particles, other known external additives may be further contained as an external additive. Examples of the other known external additives which may be contained are:

zirconia particles, zinc oxide particles, chromium oxide particles, cerium oxide particles, antimony oxide particles, tungsten oxide particles, tin oxide particles, tellurium oxide particles, manganese oxide particles and boron oxide particles. Hereafter, they may be called as "external additive particles".

The number average primary particle diameter of such external additive particles other than silica particles or alumina particles can also be adjusted, for example, by classification, or mixing of classified products. Furthermore, it is preferable that the surface of the external additive particles is also subjected to a hydrophobization treatment. A well-known surface modifying agent described above is used for the hydrophobization treatment.

The amount of the external additive added in the toner is not particularly limited, but it is preferably in the range of 0.1 to 10.0 mass %, more preferably in the range of 1.0 to 3.0 mass %, based on 100 mass % of the toner.

For mixing the external additive, a various known mixing machines such as a Turbula mixer, a Henschel mixer, a Nauta mixer, and a V-type mixer may be used.

<Toner Mother Particle>

The toner mother particles according to the present invention are preferably those having a domain-matrix structure to be described later. In addition, the toner mother particles according to the present invention contain at least a binder resin and, if necessary, may contain other constituents such as a releasing agent (wax), a colorant and a charge controlling agent.

<Binder Resin>

The binder resin according to the present invention preferably contains an amorphous resin and a crystalline resin. The toner mother particles preferably have a domain-matrix structure in which a domain phase containing a crystalline resin is dispersed in a matrix phase containing an amorphous resin. Here, the "domain-matrix structure" refers to a structure in which a domain phase having a closed interface (a boundary between a phase and a phase) is present in a continuous matrix phase. In the toner mother particles according to the present invention, it indicates a state having a portion in which the crystalline polyester is introduced into the amorphous resin in an incompatible manner. The domain phase may contain a lamellar crystalline structure. In addition, this structure can be observed by the following. In addition to the crystalline resin, a wax may be added to the domain.

Device: Electron microscope "JSM-7401F" (manufactured by JEOL Ltd.)

Sample: Section of toner particles stained with ruthenium tetraoxide ($RuO_4$) (section thickness: 60 to 100 μm)

Acceleration voltage: 30 kV

Magnification: 50000 times

Observation conditions: Transmission electron detector, bright field image

The method of preparing a section of the dyed toner particles is as follows. 1 to 2 mg of toner (a sample) is spread in a 10 mL sample bottle, and after treatment with ruthenium tetraoxide ($RuO_4$) under steam dyeing conditions as indicated below, the sample is dispersed in a photocurable resin "D-800" (manufactured by Nippon Denshi Co., Ltd.) and it is cured with light to form a block. Then, a 60 to 100 μm thick ultrathin sample was cut out of the above block using a microtome equipped with diamond teeth. Thereafter, the cut out sample was treated again under the following processing conditions and stained.

(Ruthenium Tetraoxide Treatment Conditions)

The ruthenium tetroxide treatment is performed using a vacuum electron dyeing apparatus VSC1R1 (manufactured by Filgen, Inc.). According to the device procedure, the sublimation chamber containing ruthenium tetraoxide in the staining device main body is installed. After introduction of the toner or ultrathin section into the staining chamber, treatment is performed under the staining condition of room temperature (24 to 25° C.), concentration 3 (300 Pa) and treatment time of 10 minutes. Observation of the sample obtained by the above-described treatment was performed as follows.

(Observation)

After staining, the sample was observed with an electron microscope "JSM-7401F" (manufactured by JEOL Ltd.) within 24 hours.

(Amorphous Resin)

The amorphous resin according to the present invention constitutes a binder resin together with the crystalline resin. An amorphous resin is a resin having no melting point and having a relatively high glass transition temperature (Tg) when differential scanning calorimetry (DSC) is performed on the resin.

Assuming that the glass transition temperature in the first temperature rise process is $Tg_1$ and the glass transition temperature in the second temperature rise process is $Tg_2$ in DSC measurement, from the viewpoint of reliably obtaining fixing properties such as low-temperature fixing properties, and heat resistance such as heat storage stability and blocking resistance, it is preferable that $Tg_1$ of the amorphous resin is in the range of 35 to 80° C., particularly preferably in the range in the range of 45 to 65° C. From the same viewpoint as above, $Tg_2$ of the amorphous resin is preferably in the range of 20 to 70° C., particularly preferably in the range of 30 to 55° C.

The content of the amorphous resin is not particularly limited, from the viewpoint of image strength, it is preferably in the range of 20 to 99 mass % with respect to the total amount of toner mother particles. Further, the content of the amorphous resin is more preferably in the range of 30 to 95 mass %, particularly preferably in the range of 40 to 90 mass %, with respect to the total amount of toner mother particles. When two or more resins are contained as the amorphous resin, it is preferable that the total amount of these is within the range of the above content relative to the total amount of toner mother particles. Even when an amorphous resin containing a releasing agent is used, the releasing agent in the amorphous resin containing the releasing agent is included in the content of the releasing agent constituting the toner.

There is no particular limitation on the amorphous resin according to the present invention, preferably the amorphous resin constituting the above-mentioned matrix, and conventionally known amorphous resins in the technical field are used. Among them, the amorphous resin preferably contains an amorphous vinyl resin. Particularly preferable is a styrene-acrylic copolymer resin (styrene-acrylic resin) formed by using a styrene monomer, a (meth)acrylate monomer and acrylic acid from the viewpoint of plasticity at the time of heat fixing. By using a styrene-acrylic resin as the amorphous resin, it is easy to maintain the negative chargeability as a toner. In addition, it is preferable because the negative chargeability is enhanced by emulsion aggregation of the styrene-acrylic resin to form a toner.

As the vinyl monomer that forms the amorphous vinyl resin, one or more monomers selected from the following groups may be used.

(1) Styrene Monomers

Examples of the styrene monomer are: styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene, and derivatives of these monomers.

(2) (Meth)Acrylic Acid Ester Monomers

Examples of the (meth)acrylic acid ester monomer are: methyl (meth)acrylate, ethyl (meth)acrylate, n-butyl (meth) acrylate, iso-propyl (meth)acrylate, iso-butyl (meth)acrylate, t-butyl (meth)acrylate, n-octyl (meth)acrylate, 2-ethylhexyl (meth)acrylate, stearyl (meth)acrylate, lauryl (meth) acrylate, phenyl (meth)acrylate, diethylaminoethyl (meth) acrylate and dimethylaminoethyl (meth)acrylate, and derivatives of these monomers.

(3) Vinyl Esters

Examples of the vinyl ester are: vinyl propionate, vinyl acetate, and vinyl benzoate.

(4) Vinyl Ethers

Examples of the vinyl ether are: vinyl methyl ether and vinyl ethyl ether.

(5) Vinyl Ketones

Examples of the vinyl methyl ketone are: vinyl ethyl ketone and vinyl hexyl ketone.

(6) N-Vinyl Compounds

Examples of the N-vinyl carbazole are: N-vinyl indole, and N-vinyl pyrrolidone.

(7) Others

Vinyl compounds such as vinylnaphthalene and vinylpyridine; acrylic acid or methacrylic acid derivatives such as acrylonitrile, methacrylonitrile, and acrylamide are also used.

It is preferable to use a vinyl monomer containing an ionic dissociation group such as a carboxy group, a sulfonic acid group or a phosphoric acid group. Specific examples are as follows.

Examples of the monomer containing a carboxy group are: acrylic acid, methacrylic acid, maleic acid, itaconic acid, cinnamic acid, fumaric acid, monoalkyl maleate, and monoalkyl itaconate. Examples of the monomer containing a sulfonic acid group are: styrenesulfonic acid, allylsulfosuccinic acid, and 2-acrylamido-2-methylpropanesulfonic acid. An example of a monomer containing a phosphoric acid group is acid phosphooxyethyl methacrylate.

Further, the amorphous vinyl polymer may be changed into a cross-linked resin by using a poly-functional vinyl compound as a vinyl monomer. Examples of the poly-functional vinyl compound include: divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

As described above, the vinyl resins are described in detail as a preferred embodiment of an amorphous resin. The present invention is not limited to the vinyl resins. An amorphous polyester resin may be also used.

(Crystalline Resin)

The crystalline resin according to the present invention is also not particularly limited, and a conventionally known crystalline resin in the technical field may be used. Among them, the crystalline resin preferably contains a crystalline polyester resin from the viewpoint of easily taking a structure with high crystallinity. A "crystalline polyester resin" refers to a resin having a distinct endothermic peak, not a stepwise endothermic change in calorimetry (DSC) among resins obtained by polycondensation reaction of a divalent or higher polyvalent carboxylic acid (polyvalent carboxylic acid) with a dihydric alcohol or higher (polyhydric alcohol). Specifically, the distinct endothermic peak refers to a peak having a half width of an endothermic peak within 15° C. when measured at a heating rate of 10° C./min in differential scanning calorimetry (DSC). The crystalline resin other than the crystalline polyester resin also means a resin having a distinct endothermic peak, rather than a stepwise endothermic change, in DSC as described above.

A polycarboxylic acid is a compound containing two or more carboxy group in one molecule. Specific examples of thereof are: saturated aliphatic dicarboxylic acids such as oxalic acid, succinic acid, adipic acid, sebacic acid, azelaic acid, and n-dodecyl succinic acid; an alicyclic dicarboxylic acid such as cyclohexane dicarboxylic acid; an aromatic dicarboxylic acid such as terephthalic acid; polycarboxylic acids of 3 valent or more such as trimellitic acid, and pyromellitic acid; and acid anhydrides and alkyl esters of 1 to 3 carbon atoms of these compounds. These compounds may be used alone, or may be used in combination of two or more kinds.

The polyhydric alcohol is a compound having two or more hydroxyl groups in the molecule. Specific examples thereof include: aliphatic diols such as 1,2-propanediol, 1,3-propanediol, 1,4-butanediol, 1,5-pentanediol, 1,6-hexanediol, 1,7-heptanediol, 1,8-octanediol, neopentyl glycol and 1,4-butenediol; tri- or more hydric alcohols such as glycerin, pentaerythritol, trimethylol propane and sorbitol. These compounds may be used alone, or may be used in combination of two or more kinds.

In the present invention, it is preferable that the crystalline polyester resin satisfies the following relational expression (1) and relational expression (2) in order to constitute a domain in a domain-matrix structure. Here, $C_{alcohol}$ is a carbon number of a main chain of a structural unit derived from a polyhydric alcohol for forming a crystalline polyester resin, and $C_{acid}$ is a carbon number of a main chain of a structural unit derived from the polycarboxylic acid for forming a crystalline polyester resin.

$$5 \leq |C_{acid} - C_{alcohol}| \leq 12 \quad \text{Relational expression (1):}$$

$$C_{acid} > C_{alcohol} \quad \text{Relational expression (2):}$$

As the difference in the length of the alkyl chain between the alcohol and the acid increases, aggregation of the crystalline polyester resin is more difficult, and fine dispersion of crystals becomes possible. Therefore, when the difference in alkyl chain length is 5 or more, it may be avoided that the domain is too large, and when the difference in alkyl chain length is 12 or less, it may be avoided that the domain is too small.

The content ratio of the crystalline polyester resin is preferably in the range of 5 to 20 mass % with respect to the total amount of the binder resin constituting the toner. When the content of the crystalline polyester resin is 5 mass % or more, excellent low-temperature fixability may be obtained. Further, when the content of the crystalline polyester resin is 20 mass % or less, it is excellent in that the toner may be easily produced.

In the present invention, the melting point of the crystalline polyester resin (as well as other crystalline resins) is a value measured as follows.

By using a differential scanning calorimeter "Diamond DSC" (made by PerkinElmer Inc.), a sample was sequentially subjected to a first heating cycle to heat the sample from 0° C. to 200° C. at a heating rate of 10° C./min, a cooling cycle to cool the sample from 200° C. to 0° C. at a cooling rate of 10° C./min, and a second heating cycle to heat the sample from 0° C. to 200° C. at a heating rate of 10° C./min. The measurement is done according to the measurement conditions (heating and cooling conditions) in this order. Based on the DSC curve obtained by this measurement, the endothermic peak temperature derived from the crystalline polyester in the first heating cycle is defined as the melting point (Tm) of the crystalline polyester. Specifically, 3.0 mg of the measurement sample (crystalline polyester resin) is sealed in an aluminum pan, and is placed on a sample holder of Diamond DSC. An empty aluminum pan is used as a reference.

The ratio of the crystalline resin is preferably in the range of 5 to 20 mass % with respect to the total amount of the binder resin constituting the toner. When the ratio of the crystalline resin is 5 mass % or more, a resin excellent in low-temperature fixability may be obtained. Further, when the ratio of the crystalline resin is 20 mass % or less, it is excellent in that the toner may be easily produced.

[Hybrid Crystalline Polyester Resin]

It is preferable that the crystalline resin which forms a domain in a domain-matrix structure contains a hybrid crystalline polyester resin formed by chemically bonding a vinyl polymerization segment (preferably a styrene-acrylic polymerization segment) and a crystalline polyester polymerization segment (hereinafter, it is simply as "a hybrid resin"). In this case, it is preferable that the vinyl polymerization segment (preferably a styrene-acrylic polymerization segment) and the crystalline polyester polymerization segment are bonded via a bi-reactive monomer to form a crystalline resin. By hybridizing the crystalline polyester resin with a vinyl monomer, preferably a styrene-acrylic resin, the interface between the domain and the matrix becomes smooth and the dispersibility of the crystalline resin becomes good.

(Vinyl Polymerization Segment)

The vinyl polymerization segment constituting the hybrid resin, or preferably the styrene-acrylic polymerization segment, is composed of a resin produced by polymerization of a vinyl monomer, or preferably a styrene-acrylic monomer. Here, as the vinyl monomer, those described above as the monomer constituting the vinyl resin (vinyl monomer for forming an amorphous vinyl resin) may be similarly used, so that detailed explanation will be omitted. The content of the vinyl polymerization segment in the hybrid resin is not particularly limited, but it is preferably in the range of 0.5 to 20 mass %.

(Crystalline Polyester Polymerization Segment)

The crystalline polyester polymerization segment constituting the hybrid resin is composed of a crystalline polyester resin produced by subjecting a polycarboxylic acid and a polyhydric alcohol to a polycondensation reaction in the presence of a catalyst. Here, specific types of polycarboxylic acid and polyhydric alcohol are as described above. Therefore, detailed explanation will be omitted here.

(Bi-Reactive Monomer)

A "bi-reactive monomer" is a monomer that combines a crystalline polyester polymerization segment and a vinyl polymerization segment. It is a monomer containing in the molecule both a group selected from a hydroxy group, a carboxy group, an epoxy group, a primary amino group and a secondary amino group to form a polyester polymerization segment and an ethylenically unsaturated group to form a vinyl polymerization segment. The bi-reactive monomer is preferably a monomer having a hydroxy group or a carboxy group and an ethylenically unsaturated group. More preferably, it is a monomer having a carboxy group and an ethylenically unsaturated group. That is, vinyl carboxylic acid is preferable.

Specific examples of the bi-reactive monomer include: acrylic acid, methacrylic acid, fumaric acid, and maleic acid. Specific examples thereof may also be esters of a hydroxyalkyl group having 1 to 3 carbon atoms. From the viewpoint of reactivity, acrylic acid, methacrylic acid or fumaric acid is preferable. The polyester polymerization segment and the vinyl-based polymerization segment are bonded via the bi-reactive monomer.

From the viewpoint of improving the low temperature fixability, high temperature offset resistance and durability of the toner, the amount of bi-reactive monomer to be used is preferably, for example, 1 to 10 mass parts, more preferably, 4 to 8 mass part with respect to the total amount (100 mass parts) of vinyl monomer constituting the vinyl polymerization segment.

(Preparation of Hybrid Resin)

The hybrid resin may be prepared by a process according to a known standard scheme. Typical examples of the process are the following three processes.

(1) A process of preliminarily polymerizing a crystalline polyester polymerization segment, reacting the crystalline polyester polymerization segment with a bi-reactive monomer, and further reacting a monomer for forming a vinyl polymerization segment to form a hybrid resin.

(2) A process of preliminarily polymerizing a vinyl polymerization segment, reacting the vinyl polymerization segment with a bi-reactive monomer, and further reacting the resultant with a polycarboxylic acid and a polyhydric alcohol to form a crystalline polyester polymerization segment.

(3) A process of preliminarily polymerizing a crystalline polyester polymerization segment and a vinyl polymerization segment, separately, and reacting these segments with a bi-reactive monomer to combine the segments together.

Any one of the processes may be used in the present invention. Preferred is Process (2). Specifically, the following process is preferred: a polycarboxylic acid and a polyhydric alcohol for forming a crystalline polyester polymerization segment, a monomer for forming a vinyl polymerization segment, and a bi-reactive monomer are mixed. A polymerization initiator is added to form a vinyl polymerization segment through addition polymerization of the vinyl monomer and the bi-reactive monomer. Thereafter, an esterification catalyst is added to perform a polycondensation reaction.

In this process, the catalyst for synthesizing the crystalline polyester polymerization segment may be selected from a variety of known catalysts. Examples of the esterification catalyst include tin compounds, such as dibutyltin oxide and tin(II) 2-ethylhexanoate; and titanium compounds, such as titanium diisopropylate bis(triethanolaminate). Examples of the esterification catalyst include gallic acid (3,4,5-trihydroxybenzoic acid).

<Colorant>

As the colorant contained in the toner of the present invention, known inorganic or organic colorants may be used. As the colorant, in addition to carbon black and magnetic powder, various organic and inorganic pigments and dyes may be used.

Yellow colorants which may be used for a yellow toner are: C. I. Solvent Yellows 19, 44, 77, 79, 81, 82, 93, 98, 103, 104, 112, and 162; and C. I. Pigment Yellows 14, 17, 74, 93, 94, 138, 155, 180, and 185. The mixtures of these may be also used.

Magenta colorants which may be used for a magenta toner are: C. I. Solvent Reds 1, 49, 52, 58, 63, 111, and 122; and C. I. Pigment Reds 5, 48:1, 53:1, 57:1, 122, 139, 144, 149, 166, 177, 178, and 222. The mixtures of these may be also used.

Cyan colorants which may be used for a cyan toner are: C. I. Solvent Blues 25, 36, 60, 70, 93, and 95; C. I. Pigment Blues 1, 7, 15:3, 18:3, 60, 62, 66, and 76.

Green colorants which may be used for a green toner are: C. I. Solvent Greens 3, 5, and 28; and C. I. Pigment Green 7.

Orange colorants which may be used for an orange toner are: C. I. Solvent Oranges 63, 68, 71, 72, and 78; and C. I. Pigment Oranges 16, 36, 43, 51, 55, 59, 61, and 71.

Black colorants which may be used for a black toner are: a carbon black, a magnetic material, and iron-titanium oxide black. Usable examples of a carbon black are: channel black, furnace black, acetylene black, thermal black, and lamp black. Usable examples of a magnetic material are: ferrite and magnetite.

The content ratio of the colorant is preferably in the range of 0.5 to 20 mass % with respect to the solid content (e.g., pigment, binder resin, and releasing agent) constituting the toner mother particles, more preferably it is in the range of 2 to 10 mass %. Within such a range, color reproducibility of the image may be secured.

The particle size of the colorant in terms of volume average particle diameter (volume-based median diameter) is preferably in the range of 10 to 1,000 μm, more preferably in the range of 50 to 500 μm, still more preferably in the range of 80 to 300 μm. The volume average particle diameter may be a catalog value, and for example, the volume average particle diameter (volume-based median diameter) of the colorant may be measured by "UPA-150" (manufactured by MicrotracBEL, Co. Ltd.).

<Releasing Agent>

Examples of the releasing agent according to the present invention include: dialkyl ketone waxes such as polyethylene wax, paraffin wax, microcrystalline wax, Fischer-Tropsch wax, and distearyl ketone; ester waxes such as Carnauba wax, Montan wax, behenyl behenate, trimethylol propane tribehenate, pentaerythritol tetramyristate, pentaerythritol tetrastearate, pentaerythritol tetrabehenate, pentaerythritol diacetate dibehenate, glycerin tribehenate, 1,18-octadecanediol distearate, tristearyl trimellitate, and distearyl maleate; and amide waxes such as ethylenediamine dibehenylamide, and tristearylamide trimellitate. These may be used singly or in combination of two or more.

The content ratio of the releasing agent is preferably in the range of 2 to 30 mass %, more preferably in the range of 5 to 20 mass %, based on the solid content (e.g., pigment, binder resin, and releasing agent) constituting the toner mother particles.

<Charge Controlling Agent>

A charge controlling agent may be added (internally added) to the toner according to the present invention when needed. As the charge controlling agent, a variety of known charge controlling agents may be used.

A variety of known charge controlling agents that can be dispersed in an aqueous medium may be used. Specific examples thereof include: nigrosine dyes, metal salts of naphthenic acid or higher fatty acids, alkoxylated amines, quaternary ammonium salts, azo metal complexes, and salicylic acid metal salts or metal complexes thereof.

The content of the charge controlling agent in the toner of the present invention is usually in the range of 0.1 to 10 mass parts with respect to the total amount of the binder resin, preferably in the range of 0.5 to 5 mass %.

<Morphology of Toner Mother Particle>

The morphology of the toner mother particles according to the present invention is not particularly limited and it may be, for example, a so-called single layer structure (a homogeneous structure which is not a core-shell type), a core-shell structure, or a multilayer structure having three or more layers.

<Volume-Based Median Diameter of Toner Mother Particles>

The particle diameter of the toner mother particles according to the present invention is preferably in the range of 2 to 8 μm, more preferably in the range of 3 to 6 μm, in terms of volume-based median diameter. When the volume-based median diameter of the toner mother particles is 2 μm or more, it is excellent in that sufficient fluidity may be maintained. Further, when the volume-based median diameter of the toner mother particles is 8 μm or less, it is excellent in that high image quality may be maintained. Also, when the volume-based median diameter of the toner mother particles is within the above range, the transfer efficiency is increased, the halftone image quality is improved, and the image quality such as fine lines and dots is improved.

<Measuring Method of Volume-Based Median Diameter of Toner Mother Particles>

The volume-based median diameter of toner mother particles is measured and calculated by using measuring equipment composed of "Coulter Multisizer 3" (Beckman Coulter Inc.) and a computer system installed with a data processing software.

Specifically, 0.02 g of measuring sample (toner particles) is added to 20 mL of surfactant solution (for dispersing the toner particles, e.g. a surfactant solution prepared by diluting a neutral detergent containing a surfactant component with purified water by 10 times) and is allowed to be uniform, and then the solution is subjected to ultrasonic dispersion.

The toner particle dispersion liquid thus prepared is added to "ISOTON II" (Beckman Coulter Inc.) in a beaker placed in a sample stand by a pipet until the concentration displayed on the measuring equipment reaches 8%. Here, by setting this concentration range, it is possible to obtain a reproducible measurement value. The measuring particle count of the measuring equipment is set to be 25,000. The aperture size of the measuring equipment is set to be 100 μm. The measuring range, which is from 2 to 60 μm, is divided into 256 sections to calculate the respective frequencies. The particle diameter where the accumulated volume counted from the largest size reaches 50% is determined as the volume-based median diameter ($D_{50}$).

The volume based median diameter of the toner mother particles may also be measured by separating the external additive from the toner sample to which the external additive has been treated (externally added) and using it as a sample. In that case, the external additive is separated by the following method.

Specifically, 4 g of the toner is wetted with 40 g of a 0.2 mass % aqueous solution of polyoxyethyl phenyl ether. Then by using an ultrasonic homogenizer (for example, US-1200T, manufactured by Nippon Seiki Co., Ltd.: specification frequency 15 kHz), ultrasonic energy is supplied for 30 minute so that the value of the ammeter showing the vibration instruction value attached to the main body is adjusted to indicate 60 μA (50 W). Thereafter, the external additive is washed off with a membrane filter having a pore size of 1 μm, and the toner component on the filter is measured.

[Production Method of Toner]

The production method of the toner according to the present invention is not particularly limited. Any known methods may be used. Examples of the method include: a kneading pulverization method, a suspension polymerization, an emulsion aggregation method, an emulsion polymerization aggregation method (emulsion polymerization association method), a suspension polymerization method, a polyester extension method, and a dispersion polymerization method. Among these processes, preferred is a build-up type production method such as an emulsion polymerization association method and a suspension polymerization method over a pulverization method from the viewpoint of reduction in toner particle diameter and controllability of circularity. Further among them, an emulsion polymerization aggregation method and an emulsion aggregation method may be adopted more suitably.

The emulsion polymerization aggregation method preferably used for the toner production method according to the present invention is as follows. A dispersion liquid of particles of a binder resin produced by an emulsion polymerization method (hereinafter also referred to as "binder resin particles") is mixed with particles of a colorant (hereinafter also referred to as "colorant particles") and a dispersion of a releasing agent such as wax. The toner mother particles are aggregated until they have a desired particle diameter. Further, by fusing the binder resin particles, shape control is carried out to produce toner mother particles.

The emulsion aggregation method preferably used for the toner production method according to the present invention is as follows. A binder resin solution dissolved in a solvent is dropped into a poor solvent to prepare a resin particle dispersion liquid. This resin particle dispersion liquid is mixed with a coloring agent dispersion liquid and a releasing agent dispersion liquid such as wax. The toner mother particles are aggregated until the diameter of the desired toner particles is reached. Further, by fusing the binder resin particles, shape control is carried out to produce toner mother particles.

In the toner according to the present invention, either manufacturing method is applicable.

As a manufacturing method of the toner according to the present invention, an example of the case where the emulsion polymerization aggregation method is used is described in the following.

(1) A step of preparing a dispersion liquid of colorant particles dispersed in an aqueous medium, (2) A step of preparing a dispersion liquid in which binder resin particles containing an internal additive (e.g., a releasing agent and a charge controlling agent) are dispersed in an aqueous medium as necessary, (3) A step of preparing a dispersion liquid of binder resin particles by emulsion polymerization, (4) A step of mixing the colorant particle dispersion liquid and the binder resin particle dispersion liquid to aggregate, associate and fuse the colorant particles and the binder resin particles to form toner mother particles, (5) A step of filtering toner mother particles from a dispersion system (aqueous medium) of toner mother particles to remove surfactants, (6) A step of drying the toner mother particles, and (7) A step of adding an external additive to the toner mother particles.

In the case of producing a toner by the emulsion polymerization aggregation method, the binder resin particles obtained by the emulsion polymerization method may have a multilayer structure of two or more layers made of binder resins having different compositions. The binder resin particles having such a constitution, for example, those having a two-layer structure can be produced by the following method: a dispersion liquid of resin particles is prepared by an emulsion polymerization treatment (first stage polymerization) according to a conventional method; and a polymerization initiator and a polymerizable monomer are added to this dispersion liquid, and this system is subjected to a polymerization treatment (second stage polymerization).

Further, according to the emulsion polymerization aggregation method, toner mother particles having a core-shell structure may also be obtained. Specifically, toner mother particles having a core-shell structure may be obtained as follows: first, core particles are prepared by aggregating, associating, and fusing binder resin particles for core particles and colorant particles; next, the binder resin particles for the shell layer are added to the dispersion liquid of the core particles to aggregate and fuse the binder resin particles for the shell layer on the surface of the core particles to form a shell layer covering the core particle surface.

In addition, an example of using a pulverization method as a method for producing the toner of the present invention is described below.

(1) A step of mixing a binder resin, a colorant and, when necessary, an internal additive with a Henschel mixer (2) A step of kneading the obtained mixture while heating with an extrusion kneader (3) A step of roughly grinding the obtained kneaded material with a hammer mill, and further grinding with a turbo mill (4) A step of subjecting the obtained pulverized material to fine powder classification using, for example, an air flow classifier utilizing the Coanda effect to form toner mother particles (5) A step of adding an external additive to toner mother particles to obtain toner particles

[Developer]

The developer of the present invention can be obtained by mixing the toner particles and carrier particles. The mixing apparatus used for mixing is not particularly limited, and examples thereof include a Nauta mixer, a Double cone mixer and a V-type mixer.

<Carrier Particles>

The carrier particles constitute a carrier, and have core material particles (also referred to as core material or magnetic particles) and a coating resin layer (also referred to as a coat layer) that covers the surface of the core material particles.

(Core Material Particles)

Examples of the core material particles that constitute the carrier particles of the present invention include: iron powders, magnetite, various ferrite particles, and the material in which these substances are dispersed in a resin. Among them, it is preferable to use magnetite or various ferrite particles. Preferable ferrite are: ferrite containing metals such as copper, zinc, nickel, and manganese; and light metal ferrite containing an alkali metal and/or an alkaline earth metal.

In addition, it is preferable that strontium (Sr) is contained as the core material particle. By containing strontium, irregularities on the surface of the core material particles may be increased, and even when the resin is coated, the surface is more likely to be exposed and the resistance of the carrier particles may be easily adjusted.

(Shape Factor of Core Material Particles)

The shape factor (SF-1) of the core material particles is preferably in the range of 110 to 150. The shape factor may be adjusted, for example, by changing the amount of Sr contained in the core material particles, or by the changing the firing temperature in the production process described later.

A measurement method of the shape factor (SF-1) of the core material particle is described in the following.

The shape factor (SF-1) of the core material particle is a numerical value calculated by the following Equation 1.

$$\text{Shape factor (SF-1)} = (\text{Maximum length of core material particle})/(\text{Projected area of core material particle}) \times (\pi/4) \times 100 \quad \text{Equation 1:}$$

First, the measurement method of the shape factor (SF-1) of the core material particles will be described. In measuring the shape factor (SF-1) of the core material particles, carrier particles are prepared, but when the sample is a developer instead of the single carrier particles, an advance preparation is carried out.

A developer, a small amount of neutral detergent, and pure water are placed into a beaker and allow the mixture to spread well, and the supernatant is thrown away while placing the magnet at the bottom of the beaker. Further, pure water is added and the supernatant liquid is discarded, so that only the carrier particles are separated by removing the toner and the neutral detergent. Single carrier particles may be obtained by drying 40° C.

Subsequently, the coating resin layer (coating layer, resin coating layer, and coating layer) is dissolved in a solvent and removed.

Specific procedures are as follows. 2 g of carrier particles are put into a 20 mL glass bottle, then, 15 mL of methyl ethyl ketone is put into the glass bottle, the mixture is stirred with a wave rotor for 10 minutes, and the resin coating layer is dissolved with a solvent. The solvent is removed using a magnet, and the core material particles are washed three times with 10 mL of methyl ethyl ketone. In the present invention, silica particles or alumina particles present on the carrier surface are contained in the coating resin layer. Therefore, in the case where they are not removed by the operation with the neutral detergent, silica particles or alumina particles also remain together with the core particles by dissolving the coating resin layer in the solvent. In such a case, a small amount of neutral detergent and pure water are added again to make the sample well-suited, then the supernatant liquid is thrown away while placing the magnet on the bottom of the beaker, then pure water is added and discard the supernatant liquid is discarded. In this way, only the core material particles may be separated and dried to obtain the core material particles. In the present invention, the term "core material particle" refers to the particle after carrying out this pretreatment.

Photographs of arbitral 100 or more core material particles of are taken at a magnification of 150 times with a scanning electron microscope, and a photographic image captured by a scanner was analyzed using an image processing analyzer LUZEX AP (manufactured by Nireco Corporation). The number average particle diameter is calculated as the average value of the horizontal direction Feret diameter, and the shape coefficient is a value calculated from the average value of the shape coefficients calculated by Equation 1 described above.

(Particle Diameter and Magnetization Characteristic of Core Material Particles)

The particle diameter of the core material particles is preferably in the range of 10 to 100 μm, more preferably in the range of 20 to 80 μm, as the volume average particle diameter. Further, the magnetization characteristics of the core material particles are preferably in the range of $2.5\times10^{-5}$ to $15.0\times10^{-5}$ Wb·m/kg in terms of saturation magnetization.

A method for measuring the particle size and the saturation magnetization of the core material particles is described in the following.

The volume average particle diameter of the core material particles is an average particle diameter based on volume measured by a laser diffraction particle size analyzer "HELOS" (manufactured by SYMPATEC GmbH) including a wet dispersion device. The saturation magnetization is be measured by "DC magnetization characteristic automatic recording apparatus 3257-35" (manufactured by Yokogawa Electric Corporation).

(Production Method of Core Material Particles)

After weighing an appropriate amount of the raw material, it is pulverized and mixed preferably for 0.5 hour or more, more preferably for 1 to 20 hours with a wet media mill, a ball mill, or a vibration mill. The pulverized material thus obtained was pelletized using a pressure molding machine. Thereafter, it is preferably pre-calcined at a temperature of 700 to 1200° C., preferably for 0.5 to 5 hours.

Here, instead of using a compression molding machine, after grinding, water may be added to make a slurry and granulated by using a spray dryer. After preliminary firing the mixture is further pulverized with a ball mill or a vibration mill. Subsequently, water and, if necessary, a dispersant, a binder such as polyvinyl alcohol (PVA) are added to the mixture to adjust the viscosity, and it is granulated. Then, main firing is performed. The main firing temperature is preferably 1000 to 1500° C., and the main firing time is preferably 1 to 24 hours. When pulverizing is done after the preliminary firing, water may be added and pulverized with a wet ball mill or a wet vibration mill.

The pulverizer such as the above-mentioned ball mill and vibration mill is not particularly limited, but in order to effectively and uniformly disperse the raw materials, it is preferable to use fine beads having a particle diameter of 1 cm or less in the medium to be used. Further, by adjusting the diameter, composition, and pulverization time of the beads to be used, the degree of pulverization can be controlled.

The fired product thus obtained is pulverized and classified. As a classification method, the particle diameter is adjusted to a desired particle size by using known wind classification method, mesh filtration method, or precipitation method. Thereafter, if necessary, resistance adjustment can be carried out by subjecting the surface to low temperature heating and applying an oxide film treatment. The oxide coating treatment may be performed at a temperature of, for example, 300 to 700° C. by using a general rotary electric furnace, or a batch type electric furnace. The thickness of the oxide film formed by this treatment is preferably 0.1 μm to 5 μm. When the thickness of the oxide film is within the above range, the effect of the oxide film layer is obtained, and it is preferable since the desired characteristic may be easily obtained because the oxide film thickness does not become too high. If necessary, reduction may be performed before the oxide coating treatment. Also, after classification, low magnetic products may be further separated by magnetic separation.

(Coating Resin Layer)

The coating resin layer according to the present invention is characterized by containing metal oxide particles. Further, it is preferable that the metal oxide particles are silica particles or alumina particles, and particularly silica particles are preferable.

Examples of a coating resin suitable for forming the coating resin layer according to the present invention include: polyolefin resins such as polyethylene, polypropylene, chlorinated polyethylene, and chlorosulfonated polyethylene; polyvinyl and polyvinylidene resins such as polystyrene, polyacrylate such as polymethyl methacrylate, polyacrylonitrile, polyvinyl acetate, polyvinyl alcohol, polyvinyl butyral, polyvinyl chloride, polyvinyl carbazole, polyvinyl ether, and polyvinyl ketone; copolymers such as vinyl chloride-vinyl acetate copolymer and styrene-acrylic acid copolymer; silicone resins comprising an organosiloxane bond or a modified resin thereof (such as an alkyd resin, a polyester resin, an epoxy resin, and a modified resin such as polyurethane); polytetrafluoroethylene, fluororesins such as polyvinyl fluoride, polyvinylidene fluoride, and polychlorotrifluorethylene); polyamide; polyester; polyurethane; polycarbonate; amino resins such as urea-formaldehyde resin; and epoxy resins.

Preferred is a polyacrylate resin. Specifically preferred is a resin which is obtained by polymerizing a monomer containing an alicyclic (meth)acrylic acid ester compound. By including such a constitutional unit, the hydrophobicity of the coating resin (coating resin layer) becomes high, and the moisture adsorption amount of the carrier particles decreases particularly under high temperature and high humidity. As a result, a reduction in the charge amount of the carrier under high temperature and high humidity is suppressed. In addition, since the structural unit has a rigid cyclic skeleton, the film strength of the coating resin (coating resin layer) is improved, and the durability of the carrier is improved. Further, a copolymer of an alicyclic (meth) acrylate compound and methyl methacrylate is more preferred. This is because film strength is further increased by using methyl methacrylate.

From the viewpoints of the environmental stability of the mechanical strength and the charge amount (small environmental difference of the charge amount), the ease of polymerization and the availability, the aforesaid alicyclic (meth) acrylate compound is preferably a compound containing a cycloalkyl group having 5 to 8 carbon atoms. The alicyclic (meth)acrylic acid ester compound is preferably at least one selected from the group consisting of cyclopentyl (meth) acrylate, cyclohexyl (meth)acrylate, cycloheptyl (meth) acrylate and cyclooctyl (meth)acrylate. Among these, cyclohexyl (meth)acrylate is preferably contained from the viewpoint of the environmental stability of the mechanical strength and the charge amount.

The content of the constitutional unit derived from the alicyclic (meth)acrylate compound in the coating resin used for forming the coating resin layer is preferably in the range of 10 to 100 mass % with respect to the total amount of the coating resin. More preferably, it is in the range of 20 to 100 mass %. Within this range, environmental stability and durability of the charge amount of the carrier are further improved.

The number of addition portions of the resin that forms the coating layer to the core material particles is preferably in the range of 1 to 5 mass parts, more preferably in the range of 1.5 to 4 mass parts. When the number of addition portions of the coating resin is 1 mass part or more, the charge amount may be effectively kept. In addition, when the number of addition parts of the coating resin is 5 mass parts or less, it is possible to prevent the resistance from becoming too high.

(Forming Method of Coating Resin Layer)

Specific examples of the method for producing the coating layer include a wet coating method and a dry coating method. Although each method will be described below, a dry coating method is a particularly desirable method for applying to the present invention, and it is described in detail.

As the wet coating method, the following are cited.

(1) Fluidized Bed Type Spray Coating Method

This is a method in which a coating solution prepared by dispersing a coating resin and metal oxide particles in a solvent is sprayed onto the surface of core material particles using a fluidized bed and then dried to prepare a coating resin layer.

(2) Immersion Type Coating Method

This is a method in which core material particles are immersed in a coating solution prepared by dispersing a coating resin and metal oxide particles in a solvent and coated, followed by drying to prepare a coating resin layer.

(3) Polymerization Method

This is a method in which core material particles are immersed in a coating solution for performing a coating treatment, followed by making a polymerization reaction by applying heat to prepare a coating resin layer.

(Dry Coating Method)

In the dry coating method, coating resin particles and metal oxide particles are deposited on the surface of the core material particles to be coated and then mechanical impact force is applied to melt or soften the coating resin particles and metal oxide particles to adhere to the surface of the core material particles to be coated to fix them. Thereby a coating resin layer is formed.

The core material particles, the coating resin, and the metal oxide particles are agitated at high speed using a high speed stirring mixer capable of applying a mechanical impact force under non-heating or heating condition. Then, by imparting an impulsive force repeatedly to the mixture, and by dissolving or softening it on the surface of the core material particles, fixed carrier particles are produced. As the coating condition, when heating, the temperature is preferably 80 to 130° C. The wind speed which generates the impact force is preferably 10 m/s or more during heating, and 5 m/s or less in order to suppress the aggregation of the carrier particles at the time of cooling. The time for imparting the impact force is preferably 20 to 60 minutes.

Next, in the step of coating the coating resin (coating step) or in the step after coating (after coating step), a method of stripping the resin at the convex portions of the core material particles by applying stress to the carrier particles and exposing the core material particles will be described.

In the coating process of the coating resin by the dry coating method, peeling of the resin may be caused by lowering the heating temperature to 60° C. or less while making the wind speed during cooling to be high shear. In addition, as a process after coating, it is possible to use any apparatus which is capable of performing forced stirring. For example, stirring and mixing with Turbula mixer, a ball mill, or a vibration mill may be mentioned.

In addition, as a method of exposing the core material particles by moving the resin on the surface of the convex portion toward the concave side by applying heat and impact to the coating resin, it is effective to take a long time to impart the impact force. Specifically, it is preferable to set it to 1.5 hour or more.

<Particle Diameter of Silica Particles or Alumina Particles on Carrier Particle Surface>

The number average particle diameter of the silica particles or alumina particles contained on the surface of the carrier particles is preferably in the range of 10 to 50 μm. By using relatively small particles with a number average particle diameter of 10 to 50 μm, the particles may be finely dispersed on the surface of the carrier particles, and the influence of the environment of humidity change is hardly received, and the long-term storage property of developer becomes excellent. When the number average particle diameter of the above-mentioned silica particles or alumina particles is larger than 50 μm, the silica particles or alumina particles contained on the carrier particle surface unfavorably migrate to the toner side. In addition, when the above-mentioned silica particles or alumina particles have a number average particle diameter of 10 μm or less, the particles themselves are not crushed and the aggregates are formed during the pretreatment. Also in this case, silica particles or alumina particles, which are originally intended to be contained on the surface of the carrier particles, are undesirably transferred to the toner side. From the above viewpoint, the number average particle diameter of the silica particles or the alumina particles contained on the carrier particle surface is preferably in the range of 10 to 50 μm, and more preferably in the range of 10 to 20 μm.

The number average particle diameter of the silica particles or alumina particles contained on the carrier particle surface may be determined as follows. After the carrier is separated and recovered by the above-described method of separating the carrier from the developer, it may be determined by the method described in "Measurement of particle diameter of silica particles or alumina particles on carrier particle surface" described below.

(Measurement of Particle Diameter of Silica Particles or Alumina Particles on Carrier Particle Surface)

The number average particle diameter of silica particles contained in the carrier is measured as follows. An SEM image magnified 50,000 times is captured with a scanner by using a scanning electron microscope (SEM) "JSM-7401F" (manufactured by JEOL Ltd.) and the silica particles on the carrier surface in the SEM photograph image are binarized with an image analyzer LUZEX AP (manufactured by NIRECO CORPORATION). The horizontal Feret diameters of 100 silica particles on the carrier surface are calculated, and the average is defined as the number average particle diameter. The alumina particles can also be measured in the same manner.

The silica particles or alumina particles to be added to the carrier particle surface may be known ones. However, as a method of producing silica particles or alumina particles to be added to the carrier particle surface of the present invention, a gas phase method is preferable.

Since the silica particles or alumina particles produced by the gas phase method have a shape with a low degree of sphericity, they may be contacted at a plurality of points instead of one point when the carrier is pre-treated to contain the silica particles or alumina particles. Therefore, it is preferable that the silica particles or alumina particles are hardly detached from the carrier and they are prevented from transferring to the toner side.

The production method by the gas phase method is a method of introducing a raw material of silica particles or alumina particles into a high temperature flame in a vapor state or powder state and oxidizing them to produce silica particles or alumina particles. As a raw material of silica particles, silicon halides such as silicon tetrachloride, or organosilicon compounds are mentioned. Aluminum trichloride is mainly used as a raw material of alumina particles.

Figure 2:
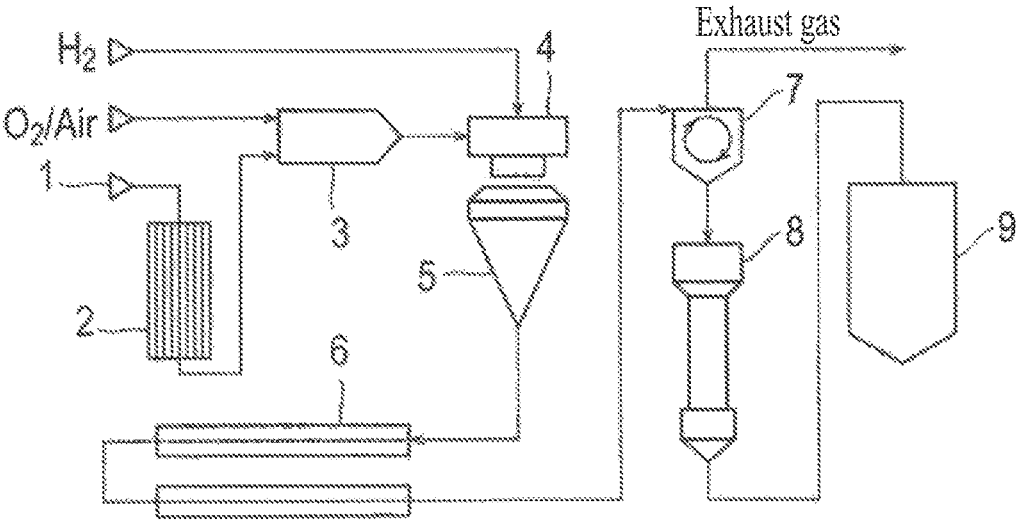
FIG. 2 is a schematic diagram illustrating an example of manufacturing equipment for producing silica particles or alumina particles by a gas phase method using a vapor.

FIG. 2 is a schematic diagram illustrating an example of manufacturing equipment for producing silica particles by a gas phase method using a vapor. In addition, the manufacturing equipment which produces the silica particles according to the present invention by the gas phase method by a vapor is not limited to this.

When silica particles are produced by a gas phase method using a vapor, specifically, they may be obtained as follows. In addition, Al particles may also be obtained similarly.

(1) First, the raw material is charged from a raw material inlet 1 and is heated and vaporized in the evaporator 2 to obtain a vapor relating to silicon.

(2) Then, introduce these vapors into a mixing chamber 3 together with an inert gas (not illustrated) such as nitrogen. To this, dry air and/or oxygen gas and hydrogen gas are mixed in a predetermined ratio to obtain a mixed gas. This mixed gas is introduced from a combustion burner 4 into a combustion flame (not illustrated) formed in a reaction chamber 5.

(3) The silica particles are formed by performing combustion treatment at a temperature of 1000 to 3000° C. in the combustion flame.

(4) After the produced particles are cooled in a cooler 6, the gaseous reaction products are separated and removed in a separator 7. At this time, hydrogen chloride adhering to the particle surface is removed in wet air when necessary. Furthermore, an acid removing treatment of hydrogen chloride is performed in a processing chamber 8 and collected by a filter to collect silica particles in a silo 9.

In the manufacturing method as described above, the influence of the flow rate of vapor relating to silicon introduced into the combustion flame, the combustion time, the combustion temperature, the combustion atmosphere, and the other combustion conditions become the control means of the particle size distribution of silica particles.

(Surface Treatment of Silica Particles or Alumina Particles)

As the silica particles or alumina particles contained in the carrier particle surface according to the present invention, those whose surface is surface-treated (hydrophobicized) with a surface treatment agent (hydrophobization agent) are preferably used. This is because the surface treatment of the silica particles or the alumina particles themselves makes it difficult to adsorb moisture, and the reduction of the charge amount can be suppressed more effectively. Note that the silica particles or alumina particles to be surface-treated as described below include silica particles or alumina particles used as an inorganic additive, which is one of the external additives of toner, in addition to the silica particles or alumina particles to be contained on the carrier surface.

As a surface treatment method of silica particles or alumina particles, the following dry methods may be mentioned, for example.

That is, the surface treatment agent is diluted with a solvent such as tetrahydrofuran (THF), toluene, ethyl acetate, methyl ethyl ketone, acetone ethanol and hydrogen chloride saturated ethanol. While forcibly stirring the silica particles or the alumina particles with a blender, the diluted solution of the surface treatment agent is added dropwise or sprayed and thoroughly mixed. In that case, apparatuses, such as a kneader coater, a spray dryer, a Carmal processor, and a fluid bed, may be used.

Next, the resulting mixture is transferred to a vat, and heated and dried in an oven. Thereafter, the mixture is sufficiently crushed again by a mixer or a jet mill. It is preferable to classify the obtained crushed material as needed. In the method as described above, in the case of surface treatment using a plurality of types of surface treatment agents, each surface treatment agent may be treated at the same time or may be treated separately.

Besides such dry methods, the following wet methods are also used: a method of immersing silica particles or alumina particles in organic solvent solution of coupling agent (surface treatment agent; hydrophobization agent) and then drying; and a method of dispersing composite oxide particles in water and making it into a slurry, and then dropping an aqueous solution of a surface treatment agent, and then settling the silica particles or alumina particles and heating to dry and crush them.

In the surface treatment as described above, the heating temperature is preferably 100° C. or higher. When the temperature at the time of heating is less than 100° C., the condensation reaction between the silica particles or alumina particles and the surface treatment agent is difficult to complete.

Examples of surface treatment agents used for surface treatment include those used as usual surface treatment agents such as silane coupling agents such as hexamethyldisilazane, titanate coupling agents, silicone oils and silicone varnishes. Furthermore, a fluorine-based silane coupling agent, a fluorine-based silicone oil, a coupling agent having an amino group or a quaternary ammonium base, and a modified silicone oil may also be used. It is preferable to use these surface treatment agents in a state of being dissolved in a solvent such as ethanol.

In the present invention, the silica particles or the alumina particles are surface-treated with a surface treatment agent, the surface treatment agent is a silane coupling agent having an alkyl chain, and a compound represented by the following formula (3) is particularly preferable. As the surface treatment agent for the silica particles or the alumina particles, known ones may be used as described above, but it is preferably a silane coupling agent having an alkyl chain, which is a compound represented by the following formula (3). Thus, by adding silica particles or alumina particles containing a surface treatment agent having a highly hydrophobic alkyl chain to the carrier surface and the toner surface, it is possible to enhance the hydrophobicity as a developer. The charge retention ability between carrier and toner may be enhanced, and charge leakage may be suppressed even in a humid environment. In addition, the long-term storage property of the charge amount may be improved.

$$X—Si(OR)_3 \qquad \text{Formula (3):}$$

In the above-described formula, X represents an alkyl group having 6 to 20 carbon atoms, and R represents a methyl group or an ethyl group.

In Formula (3), X represents an alkyl group having 6 to 20 carbon atoms. In order to improve the initial charge amount and the stability of the charge amount, X is preferably an alkyl group having 8 to 16 carbon atoms.

In Formula (3), R is a methyl group or an ethyl group from the viewpoint of relatively low steric hindrance. As the steric structure of R is smaller, the surface treatment of the silica particles or the alumina particles is promoted, and the effect of improving the chargeability is more easily obtained. R may be a hydrogen atom from the viewpoint of small steric hindrance, but at this time, "OR" in the above formula (3) is a hydroxy group. Then, the chemical affinity between the alkoxysilane compound as a surface treatment agent and water is increased, and this will cause a leak point of the charge amount under a high temperature and high humidity environment. Therefore, in order to suppress such a leak, R is a methyl group or an ethyl group. An ethyl group is preferable because the surface treatment of the silica particles or the alumina particles is promoted, and it is excellent in the effect of improving the chargeability.

Examples of the alkoxy silane compound used for a surface treating agent are: n-hexyltrimethoxysilane, n-hexyltriethoxysilane, n-heptyltrimethoxysilane, n-heptyltriethoxysilane, n-octyltrimethoxysilane, n-octyltriethoxysilane, n-nonyltrimethoxysilane, n-nonyltriethoxysilane, n-decyltrimethoxysilane, n-decyltriethoxysilane, n-undecyltrimethoxysilane, n-undecyltriethoxysilane, n-dodecyltrimethoxysilane, n-dodecyltriethoxysilane, n-tridecyltrimethoxysilane, n-tridecyltriethoxysilane, n-tetradecyltrimethoxysilane, n-tetradecyltriethoxysilane, n-pentadecyltrimethoxysilane, n-pentadecyltriethoxysilane, n-Hexadecyltrimethoxysilane and n-hexadecyltriethoxysilane.

As the silica particles or alumina particles to be contained in the carrier surface (and the toner surface), known ones may be used, but those which have been surface-treated with a surface treatment agent as described above are preferable. Such silica particles or alumina particles can be produced and further surface-treated by the method as described above, or commercially available products may be used. Specific examples of commercially available silica particles are: R-805, R-976, R-974, R-972, R-812, R-809, R202, RX200, RY200, and NAX50 (made by Nippon Aerosil Co. Ltd.); H1303VP, HVK2150, H2000, H2000T, H13TX, H30TM, H20TM, and H13TM (made by Clariant Co. Ltd.); and TS-630 and TG-6110 (made by Cabot Corp.). Specific examples of commercially available plumina particles are: Alu C, Alu C 65, Alu 130, Alu C 805 (made by Nippon Aerosil Co. Ltd.); TG-A90 (made by Cabot Japan Co. Ltd.); and AKP-G07 (Sumitomo Chemical Co. Ltd.).

As a method of containing silica particles or alumina particles, it may be cited a method of containing (externally adding) to the carrier surface (and the toner surface) by using various known mixing devices such as a Turbula mixer, a Henschel mixer, a Nauta mixer, and a V-type mixer.

<Characteristics of Carrier>

(Resistance of Carrier)

It is preferable that the carrier particles according to the present invention have a resistance in the range of $1.0\times10^{9}$ to $1.0\times10^{11}$ Ω·cm. More preferably, the resistance is in the range of $1.0\times10^{9}$ to $5.0\times10^{19}$ Ω·cm. When the resistance is $1.0\times10^{9}$ Ω·cm or more, it is possible to prevent the charged electric charge as a developer from being easily leaked. When the resistance is $1.0\times10^{19}$ Ω·cm or less, it is possible to prevent the rising of charging from becoming worse at the time of stirring in the developing device.

The resistance of the carrier particles in the present invention indicates the resistance of the carrier particles obtained by separating the toner particles from the developer at the start of use of the carrier particles. The resistance is measured by a resistance measuring method to be described later. The resistance of the carrier particles in the present invention is the resistance that is dynamically measured under the developing condition by the magnetic brush. An aluminum electrode drum having the same size as the photosensitive drum is replaced with the photosensitive drum. Then, the carrier particles are supplied onto the developing sleeve to form a magnetic brush. The formed magnetic brush is rubbed against the electrode drum. A voltage (500 V) is applied between the developing sleeve and the electrode drum to measure the current flowing therebetween. The resistance of the carrier particles is obtained by the following expression.

$DVR(\Omega\cdot cm)=(V/I)\times(N\times L/DSD)$

In the aforesaid expression, the symbols indicate the following.

DVR: Resistance of carrier particles (Ω·cm)

V: Voltage between the developing sleeve and the electrode drum (V)

I: Measured electric current (A)

N: Developing nip width (cm)

L: Developing sleeve length (cm)

DSD: Distance between the developing sleeve and the electrode drum (cm)

In the present invention, the measurement was done with the conditions of: V=500V, N=1 cm, L=6 cm, and DSD=0.6 mm.

(Particle Diameter of Carrier Particles)

It is preferable that the carrier particles have a volume-based median diameter in the range of 10 to 100 μm, more preferably 20 to 80 μm. The volume average particle diameter of the carrier particles may be measured using carrier particles separated from the developer as described above. The volume-based median diameter of the carrier particles may be measured by a laser diffraction particle size analyzer "HELOS" (manufactured by SYMPATEC GmbH) including a wet dispersion device.

[Image Forming Method Using Electrostatic Charge Image Developer]

The image forming method used in the present invention may be any image forming method using the above-described electrostatic charge image developer, and forms an image forming layer on the recording medium using the toner of the developer described above. As a result, the charge amount of the starter developer may be maintained from immediately after preparation of the developer to after a long period of time, and it is possible to output stable image quality for a long time after use.

The image forming method according to the present invention can be suitably used for a full-color image forming method using four types of toner, black toner, yellow toner, magenta toner and cyan toner.

In the full-color image forming method, the following methods may be used: a method using a 4 cycle type image forming apparatus constituted by four types of color developing devices related to each of yellow, magenta, cyan, and black and one electrostatic latent image bearing member (also referred to as "electrophotographic photoreceptor" or simply "photoreceptor"); and a method using a tandem type image forming apparatus in which image forming units each having a color developing device and an electrostatic latent image bearing member for each color are mounted for each color. Any image forming method may be used.

As a color image forming method, an image forming method including a fixing step by a heat pressure fixing method capable of applying pressure while heating may be preferably cited.

In this color image forming method, specifically, an electrostatic latent image formed on the photoreceptor is developed by using the above-described toner to obtain a toner image. This toner image is transferred to an image support, and thereafter the toner image transferred onto the image support is fixed to the image support by a fixing process of a heat pressure fixing system. Thereby it is possible to obtain a printed matter on which a visible image is formed.

The pressure application and heating in the fixing step are preferably simultaneous. Alternatively, pressure may be applied first, followed by heating.

Further, the image forming method according to the present invention is suitably used in an image forming method of a heat pressure fixing system. As a fixing device of the heat pressure fixing system used in the image forming method according to the present invention, various known ones can be adopted. Hereinafter, a heat roller type fixing device and a belt heating type fixing device will be described as a thermal pressure fixing device.

(i) Fixing Device of Heat Roller System

A heat roller type fixing device generally has a pair of rollers composed of a heating roller and a pressure roller in contact with the heating roller. In the fixing device, the pressure roller is deformed by the pressure applied between the heating roller and the pressure roller, so that a so-called fixing nip portion is formed in this deformed portion.

In general, the heating roller is formed by disposing a heat source such as a halogen lamp inside a core metal made of a hollow metal roller made of aluminum. In the heating roller, the core metal is heated by the heat source. At this time, the energization to the heat source is controlled and the temperature is adjusted so that the outer peripheral surface of the heating roller is maintained at a predetermined fixing temperature.

In the case where the fixing device is used in an image forming apparatus for forming a full color image consisting of four toner layers (yellow, magenta, cyan and black) or five layers of toner (yellow, magenta, cyan, black and clear) which is required to have a capability of sufficiently heating and melting a toner image to cause color mixing, the fixing device is preferable to have the following configuration. That is, the fixing device preferably includes a core metal having a high heat capacity as a heating roller and including a core layer formed with an elastic layer for uniformly melting a toner image on the outer peripheral surface of the core metal preferable.

Further, the pressure roller has an elastic layer made of a soft rubber such as urethane rubber or silicone rubber.

As the pressure roller, it is also possible to use a core metal having a hollow metal roller made of aluminum and having an elastic layer formed on the outer peripheral surface of the core metal.

Further, when the pressure roller has a core metal, a heat source such as a halogen lamp may be disposed in the core metal in the same manner as the heating roller. It may be configured to control the temperature by controlling the energization to the heat source so that the core metal is heated by the heat source and the outer peripheral surface of the pressure roller is maintained at a predetermined fixing temperature.

As these heating rollers and/or pressurizing rollers, it is preferable to use one which has an outermost layer provided with a releasing layer made of a fluoro resin such as polytetrafluoroethylene (PTFE), or tetrafluoroethylene-perfluoroalkylvinylether copolymer (PFA).

In such a heat roller type fixing apparatus, the pair of rollers is rotated and the image support that forms a visible image is conveyed to a fixing nip portion. Thereby, heating by the heating roller and application of pressure in the fixing nip portion are performed, whereby the unfixed toner image is fixed on the image support.

The image forming method according to the present invention can maintain the charge amount of the starter developer from immediately after preparation of the developer to after a long period of time, and can output stable image quality for a long time after use. It has a feature that the low temperature fixability is also good. Therefore, in the fixing device of the heat roller type, the temperature of the heating roller may be made comparatively low, specifically 150° C. or less. Further, the temperature of the heating roller is preferably 140° C. or less, more preferably 135° C. or less. From the viewpoint of excellent low-temperature fixability, the temperature of the heating roller is preferably as low as possible, and its lower limit value is not particularly limited, but is substantially around 90° C.

(ii) Fixing Device of Belt Heating System

A belt heating type fixing device generally comprises a heating member made of, for example, a ceramic heater, a pressure roller, and a fixing belt made of a heat resistant belt sandwiched between the heating member and the pressure roller. The pressure roller is deformed by the pressure applied between the heating member and the pressure roller. By this, a so-called fixing nip portion is formed in this deformed portion.

As the fixing belt, heat resistant belts and sheets made of polyimide are used. The fixing belt may have a configuration of: a heat-resistant belt or sheet made of polyimide as a substrate; and a releasing layer formed thereon made of a fluoro resin such as polytetrafluoroethylene (PTFE) or tetrafluoroethylene-perfluoroalkyl vinyl ether copolymer (PFA). Further, it may have a configuration in which an elastic layer made of rubber is provided between the substrate and the releasing layer.

In such a belt heating type fixing device, an image supporting member that carries an unfixed toner image is held and conveyed together with the fixing belt between a fixing belt and a pressure roller that forms a fixing nip portion. Thereby, heating by the heating member via the fixing belt and application of pressure at the fixing nip portion are performed, and the unfixed toner image is fixed on the image support.

According to such a belt heating type fixing device, the heating member may be energized only at the time of image formation so as to generate heat at a predetermined fixing temperature. Therefore, it is possible to shorten the waiting time from when the image forming apparatus is powered on until the image formation can be executed. In addition, the power consumption of the image forming apparatus at the time of standby is extremely small, and power saving may be achieved.

As described above, the heating member, the pressure roller and the fixing belt used as the fixing member in the fixing step are preferably those having a plurality of layer configurations.

In the belt heating type fixing apparatus, the temperature of the heating member may be made relatively low, specifically 150° C. or less. Further, the temperature of the heating member is preferably 140° C. or less, more preferably 135° C. or less. From the viewpoint of excellent low-temperature fixability, the temperature of the heating member is preferably as low as possible, and its lower limit value is not particularly limited, but is substantially 90° C. or so.

(Recording Medium)

Recording media (also referred to as recording materials, recording papers, or recording papers) may be those commonly used. For example, there is no particular limitation as long as it holds a toner image formed by a known image forming method using an image forming apparatus. Examples of usable image support materials include: plain paper from thin paper to thick paper, high-quality paper, art paper, or coated printing paper such as coated paper, commercially available Japanese paper or postcard paper, OHP Plastic films, cloths, various resin materials used for so-called soft packaging, resin films formed by molding them into a film, and labels.

Although the embodiments of the present invention have been described and illustrated in detail, the disclosed embodiments are made for purpose of illustration and example only and not limitation. The scope of the present invention should be interpreted by terms of the appended claims.

EXAMPLES

Hereinafter, the present invention will be specifically described with reference to examples, but the present invention is not limited thereto.

<Preparation of Crystalline Polyester Resin Particle Dispersion Liquid>

(Synthesis of Crystalline Polyester Resin 1)

281 mass parts of tetradodecanedioic acid as a polycarboxylic acid compound of the material of the polyester polymerization segment, and 283 mass parts of 1,6-hexanediol as a polyvalent alcohol compound, were placed in a reaction vessel equipped with a nitrogen introducing device, a dehydration tube, a stirrer, and a thermocouple. The mixture was heated to 160° C. for dissolution.

On the other hand, a previously mixed solution made of 23.5 mass parts of styrene, 6.5 mass parts of n-butyl acrylate, 2.5 mass parts of dicumyl peroxide and 2 mass parts of acrylic as a bi-reactive monomer, which are materials of a vinyl-based polymer segment, was added dropwise over 1 hour by a dropping funnel. Stirring was continued for 1 hour while maintaining at 170° C. to polymerize styrene, n-butyl acrylate and acrylic acid. Thereafter, 2.5 mass parts of tin (II) 2-ethylhexanoate and 0.2 mass parts of gallic acid were added, and the temperature was raised to 210° C., and the reaction was carried out for 8 hours. Furthermore, the reaction was carried out at 8.3 kPa for 1 hour to obtain a hybridized crystalline polyester resin 1. The styrene-acrylic polymerized segment (vinyl-based polymerized segment) polymerized in the crystalline polyester was 5 mass % in 100 mass % of the total resin amount of the hybridized crystalline polyester resin 1.

(Preparation of Crystalline Resin Particle Dispersion Liquid 1)

100 mass parts of the crystalline polyester resin 1 were dissolved in 400 mass parts of ethyl acetate. Then, 25 mass parts of 5% of aqueous sodium hydroxide solution were added thereto to prepare a crystalline resin solution. This crystalline resin solution was placed in a reaction vessel having a stirrer and 638 mass parts of 0.26% of aqueous sodium lauryl sulfate were dropped and mixed over a period of 30 minutes. In the course of the dropwise addition of the aqueous sodium lauryl sulfate solution, the liquid in the vessel became cloudy, and after the whole amount of the aqueous sodium lauryl sulfate solution was dropped, an emulsion was prepared in which the crystalline resin fine particles were uniformly dispersed.

Subsequently, while this emulsion was heated to 40° C., the reaction mixture was subjected to a reduced pressure of 150 hPa by using a diaphragm vacuum pump "V-700" (manufactured by BUCHI, Co. Ltd.) to remove ethyl acetate. Thereby, a crystalline resin particle dispersion 1 in which crystalline resin fine particles made of polyester resin are dispersed.

<Preparation of Amorphous Resin Particle Dispersion Liquid 1>

(First Stage Polymerization)

Into a reaction vessel equipped with a stirrer, a temperature sensor, a cooling tube, and a nitrogen introducing device, a solution of 4 mass parts of sodium polyoxyethylene (2) dodecyl ether sulfate dissolved in 3,000 mass parts of ion-exchanged water were charged. While stirring at a stirring speed of 230 rpm under a nitrogen flow, the inner temperature of the reaction vessel was raised to 80° C. After raising the temperature, a solution of 10 mass parts of potassium persulfate dissolved in 200 mass parts of ion-exchanged water was added thereto, and the liquid temperature was raised to 75° C. A mixed solution of the following monomer mixture was added dropwise to this solution over a period of 1 hour.

Styrene: 584 mass parts n-Butyl acrylate: 160 mass parts

Methacrylic acid: 56 mass parts

After dropping the mixture, the reaction system was heated and stirred at 75° C. for 2 hours to carry out the polymerization. Thus, a dispersion liquid of resin particles (b1) was prepared.

(Second Stage Polymerization)

Into a reaction vessel equipped with a stirrer, a temperature sensor, a cooling tube, and a nitrogen introducing device, a solution of 2 mass parts of sodium polyoxyethylene (2) dodecyl ether sulfate dissolved in 3,000 mass parts of ion-exchanged water was charged. The inner temperature of the reaction vessel was raised to 80° C. Subsequently, 42 mass parts in terms of solid content of the dispersion liquid of resin particles (b1) prepared above, 70 mass parts of microcrystalline wax "HNP-190" (made by Nippon Seiro Co. Ltd.), and a monomer mixture containing the following were added.

Styrene: 239 mass parts n-Butyl acrylate: 111 mass parts

Methacrylic acid: 26 mass parts n-Octyl mercaptan: 3 mass parts

The reaction system was mixed and dispersed for 1 hour by using a mechanical disperser with a circulation route "CLEARMIX" (manufactured by M Technique Co., Ltd.) so that a dispersion liquid containing emulsion particles (oil particles) was prepared. Then, an initiator solution prepared by dissolving 5 mass parts of potassium persulfate in 100 mass parts of ion-exchanged water was added to the dispersion liquid, and the system was heated and stirred at 80° C. for 1 hour to carry out polymerization. Thereby a dispersion liquid of resin particles (b2) was prepared.

(Third Stage Polymerization)

A solution of 10 mass parts of potassium persulfate in 200 mass parts of ion-exchanged water was added to the obtained dispersion liquid of resin particles (b2). Further, under the temperature condition of 80° C., a mixed solution of the following monomers was added dropwise over a period of 1 hour.

Styrene: 380 mass parts n-Butyl acrylate: 132 mass parts

Methacrylic acid: 39 mass parts n-Octyl mercaptan: 6 mass parts

After completion of the addition, the solution was heated with stirring for 2 hours to carry out polymerization. After cooling to 28° C., an amorphous resin particle dispersion liquid 1 was prepared.

<Preparation of Colorant Particle Dispersion Liquid [Bk]>

90 mass parts of sodium dodecyl sulfate were added to 1600 mass parts of ion-exchanged water. While stirring the solution, 420 mass parts of carbon black "Regal 330R" (manufactured by Cabot Corp.) were gradually added to the solution. Subsequently, by dispersion with a stirrer "CLEARMIX" (manufactured by M Technique Co., Ltd.), a colorant particle dispersion liquid [Bk] was prepared.

<Production of Toner Mother Particles 1>: Without Crystalline Resin (Aggregation-Fusion Process)

Into a reaction vessel equipped with a stirrer, a temperature sensor, a cooling tube and a nitrogen introduction device, the following ingredients were placed: 300 mass parts (in terms of solid content) of the amorphous resin particle dispersion liquid 1, 1100 mass parts of ion-exchanged water, and 40 mass parts (in terms of solid content) of the colorant particle dispersion liquid [Bk]. After adjusting the liquid temperature to 30° C., the pH was adjusted to 10 by adding 5 N sodium hydroxide aqueous solution. Next, an aqueous solution of 60 mass parts of magnesium chloride dissolved in 60 mass parts of ion-exchanged water was added under stirring at 30° C. over a period of 10 minutes. After keeping the temperature for 3 minutes, the system was heated to 85° C. over a period of 60 minutes, while maintaining the temperature of 85° C., the particles were aggregated and the particle growth reaction was continued. The particle size of the aggregated particles was measured by using a "Coulter Multisizer 3" (Beckman Coulter Inc.)". When the volume-based average particle size reached 6 μm, an aqueous solution of 40 mass parts of sodium chloride dissolved in 160 mass parts of ion-exchanged water was added to terminate the particle growth. Further, as an aging step, heating and stirring were carried out at a liquid temperature of 80° C. for 1 hour to progress the fusion between the particles, whereby a dispersion liquid of the toner mother particles 1 was prepared.

(Cleaning-Drying Process)

The resulting dispersion liquid of the toner mother particles 1 was subjected to solid-liquid separation with a basket type centrifuge "MARK III type number 60×40+M" (manufactured by Matsumoto Machinery Manufacturing Co., Ltd.) to form a wet cake of toner mother particles. The obtained wet cake was washed with ion-exchanged water at 40° C. with the same basket type centrifuge until the electric conductivity of the filtrate reached 5 μS/cm. Thereafter, it was transferred to a flash jet dryer (manufactured by Seishin Enterprise Co. Ltd.) and dried until the water content reached 0.5%. Thereby toner mother particles 1 were prepared.

<Production of Toner Mother Particles 2>

(Aggregation-Fusion Process)

Into a reaction vessel equipped with a stirrer, a temperature sensor, a cooling tube and a nitrogen introduction device, the following ingredients were placed: 300 mass parts (in terms of solid content) of the amorphous resin particle dispersion liquid 1, 34 mass parts (in terms of solid content) of the crystalline resin particle dispersion liquid 1, 1100 mass parts of ion-exchanged water, and 40 mass parts (in terms of solid content) of the colorant particle dispersion liquid [Bk]. After adjusting the liquid temperature to 30° C., the pH was adjusted to 10 by adding 5 N sodium hydroxide aqueous solution. Next, an aqueous solution of 60 mass parts of magnesium chloride dissolved in 60 mass parts of ion-exchanged water was added under stirring at 30° C. over a period of 10 minutes. After keeping the temperature for 3 minutes, the system was heated to 85° C. over a period of 60 minutes, while maintaining the temperature of 85° C., the particles were aggregated and the particle growth reaction was continued. The particle size of the aggregated particles was measured by using a "Coulter Multisizer 3" (Beckman Coulter Inc.)". When the volume-based average particle size reached 6 μm, an aqueous solution of 40 mass parts of sodium chloride dissolved in 160 mass parts of ion-exchanged water was added to terminate the particle growth. Further, as an aging step, heating and stirring were carried out at a liquid temperature of 80° C. for 1 hour to progress the fusion between the particles, whereby a dispersion liquid of the toner mother particles 2 was prepared.

(Cleaning-Drying Process)

The resulting dispersion liquid of the toner mother particles 2 was subjected to solid-liquid separation with a basket type centrifuge "MARK III type number 60×40+M" (manufactured by Matsumoto Machinery Manufacturing Co., Ltd.) to form a wet cake of toner mother particles. The obtained wet cake was washed with ion-exchanged water at 40° C. with the same basket type centrifuge until the electric conductivity of the filtrate reached 5 μS/cm. Thereafter, it was transferred to a flash jet dryer (manufactured by Seishin Enterprise Co. Ltd.) and dried until the water content reached 0.5%. Thereby toner mother particles 2 were prepared.

TABLE I

| Toner mother particle No. | Crystal line resin Present or Absent |
|---|---|
| 1 | Absent |
| 2 | Present |

<Preparation of Toner Particles 1>

(External Additive Addition Process)

To 100 mass parts of toner mother particles 1 were added the following: 0.6 mass parts of hydrophobic silica (number-based median diameter=12 μm, surface treating agent: octylsilane), 0.9 mass parts of hydrophobic silica (number-based median diameter=30 μm, surface treating agent: hexamethyl silazane), and 0.4 mass parts of hydrophobic alumina (number-based median diameter=13 μm, surface treatment agent: isobutylsilane). The resultant composition was mixed for 20 minutes using a Henschel mixer to obtain toner particles 1. Confirmation of the domain-matrix structure revealed that there were no domains (phases) of the crystalline polyester resin.

<Preparation of Toner Particles 2>

(External Additive Addition Process)

To 100 mass parts of toner mother particles 2 were added the following: 0.6 mass parts of hydrophobic silica (number-based median diameter=12 μm, surface treating agent: octylsilane), 0.9 mass parts of hydrophobic silica (number-based median diameter=30 μm, surface treating agent: hexamethyl silazane), and 0.4 mass parts of hydrophobic alumina (number-based median diameter=13 μm, surface treatment agent: isobutylsilane). The resultant composition was mixed for 20 minutes using a Henschel mixer to obtain toner particles 2. Confirmation of the domain-matrix structure revealed that there were domains (phases) of the crystalline polyester resin.

<Preparation of Core Material Particles>

An appropriate amount of each raw material is blended so that 19.0 mol % in MnO conversion, 2.8 mol % in MgO conversion, 1.5 mol % in SrO conversion, and 75.0 mol % in $Fe_2O_3$ conversion. Water was added to the mixture, it was ground in a wet ball mill for 10 hours, mixed and dried. After holding at 950° C. for 4 hours, the slurry milled with a wet ball mill for 24 hours was granulated and dried. Then, this substance was placed in a baking furnace to fill 50% of the furnace volume. After holding at a circumferential speed of 10 m/s at 1300° C. for 4 hours, it was crushed and adjusted to a particle diameter of 33 μm to obtain core particles.

<Preparation of Carrier Particles 1>

100 mass parts of the prepared core material particles, 3.5 mass parts of copolymer resin particles of cyclohexyl methacrylate-methyl methacrylate (copolymerization ratio 5/5), and 0.5 mass parts of silica particles (R805: 12 μm, made by Aerosil Co. Ltd.) were charged into a high-speed mixer with stirring blades. The mixture was stirred and mixed at a wind speed of 10 m/s at 125° C. for 45 minutes. A resin coating layer was formed on the surface of the core material particles by the action of a mechanical impact force. Then, it was cooled by lowering the wind speed to 2 m/s. Thus, carrier particles 1 coated with a resin were prepared. The Si element measured by XPS was 1.1 at %. XPS measurement was performed by the method described above.

<Preparation of Carrier Particles 2 to 14>

The carrier particles 2 to 14 were produced in the same manner as preparation of the carrier particles 1 except that the kinds and the addition amounts of metal oxide particles were changed as indicated in the following Table II.

TABLE II

| | Metal oxide particles contained in coating resin layer | | |
|---|---|---|---|
| Carrier particle No. | Type of particles | Number average particle diameter (nm) | Added amount (mass parts) |
| 1 | Silica | 12 | 0.50 |
| 2 | Silica | 12 | 1.00 |
| 3 | Silica | 12 | 2.00 |
| 4 | Silica | 12 | 2.50 |
| 5 | Alumina | 13 | 0.90 |
| 6 | Alumina | 13 | 3.00 |
| 7 | Alumina | 13 | 4.00 |
| 8 | Silica | 12 | 0.40 |
| 9 | Silica | 12 | 3.10 |
| 10 | Alumina | 13 | 0.65 |
| 11 | Alumina | 13 | 4.50 |
| 12 | Carbon black | 100 | 2.00 |
| 13 | Titania | 20 | 5.50 |
| 14 | Silica/Alumina | 12/13 | 1.00/1.00 |

<Preparation of Developer 1>

Developer 1 was prepared by adding 1.0 kg of the carrier particles 1 and the toner particles 1 prepared above so that the toner concentration became 6.5 mass %, and mixing for 30 minutes.

<Preparation of Developer 2 to 15>

Developers 2 to 15 were prepared in the same manner as preparation of the developer 1 except that the type of toner particles mixed with the carrier particles was changed as indicated in the following Table III.

TABLE III

| Developer No. | Toner particle No. | Carrier Particle No. | Metal oxide particles contained in coating resin layer Type of particles | Metal element in metal oxide particles contained in coating resin layer: Metal element | Amount of metal element on surface (at %) | Remarks |
|---|---|---|---|---|---|---|
| 1 | 1 | 1 | Silica | Si | 1.1 | Present invention |
| 2 | 1 | 2 | Silica | Si | 2.1 | Present invention |
| 3 | 1 | 3 | Silica | Si | 4.1 | Present invention |
| 4 | 1 | 4 | Silica | Si | 5.9 | Present invention |
| 5 | 1 | 5 | Alumina | Al | 1.3 | Present invention |
| 6 | 1 | 6 | Alumina | Al | 4.1 | Present invention |
| 7 | 1 | 7 | Alumina | Al | 5.7 | Present invention |
| 8 | 1 | 14 | Silica/Alumina | Si/Al | 2.0/1.2 | Present invention |
| 9 | 2 (Containing crystalline resin) | 2 | Silica | Si | 2.1 | Present invention |
| 10 | 1 | 8 | Silica | Si | 0.9 | Comparative example |
| 11 | 1 | 9 | Silica | Si | 6.3 | Comparative example |
| 12 | 1 | 10 | Alumina | Al | 0.9 | Comparative example |
| 13 | 1 | 11 | Alumina | Al | 6.2 | Comparative example |
| 14 | 1 | 12 | Carbon black | — | — | Comparative example |
| 15 | 1 | 13 | Titania | Ti | 4.0 | Comparative example |

[Evaluation]

A commercially available multifunctional peripheral apparatus "bizhub PRO 6501" (made by Konica Minolta, Inc.) was used for the following evaluations.

<Evaluation 1: Initial Charging Stability (Charging Fluctuation)>

The developer was charged in a developing device, and left for 12 hours in a normal temperature and normal humidity environment (20° C., 50% RH), and then the charge amount was measured. Furthermore, 10,000 sheets of print which forms a solid image having 5% of printing rate on A4 high quality paper (65 g/m$^2$) under the same environmental conditions was made for comparison. And evaluation was done. The charge amount was measured using a blow-off charge amount measuring apparatus "TB-200" (manufactured by Toshiba Chemical Co., Ltd. (currently: Kyocera Chemical Co., Ltd.)) by sampling a two-component developer in the developing device. The evaluation ranking of ◎ and ○ indicated below passed examination.

(Evaluation Criteria)

◎: The fluctuation value Δ of the charge amount of toner is less than 5 μC/g between an initial printing stage and after printing 10,000 sheets.

○: The fluctuation value Δ of the charge amount of toner is 5 μC/g or more to less than 10 μC/g between an initial printing stage and after printing 10,000 sheets.

X: The fluctuation value Δ of the charge amount of toner is 10 μC/g or more between an initial printing stage and after printing 10,000 sheets.

<Evaluation 2: HH Environment Charging Stability (Durability in HH Environment)>

In the same manner as in Evaluation 1, the developer was filled in a developer, and after standing for 12 hours in a high temperature and high humidity environment (30° C., 80% RH), the charge amount was measured. Furthermore, 200,000 sheets of print which forms a solid image having 5% of printing rate on A4 high quality paper (65 g/m$^2$) under the same environmental conditions was made for comparison. And evaluation was done. The charge amount was measured using a blow-off charge amount measuring apparatus "TB-200" (manufactured by Toshiba Chemical Co., Ltd.) by sampling a two-component developer in the developing device. The evaluation ranking of ◎ and ○ indicated below passed examination.

(Evaluation Criteria)

◎: The fluctuation value Δ of the charge amount of toner is less than 5 μC/g between an initial printing stage and after printing 200,000 sheets.

○: The fluctuation value Δ of the charge amount of toner is 5 μC/g or more to less than 10 μC/g between an initial printing stage and after printing 200,000 sheets.

X: The fluctuation value Δ of the charge amount of toner is 10 μC/g or more between an initial printing stage and after printing 200,000 sheets.

<Evaluation 3: HH Environment Image Quality (HH Environment GI Value)>

In the evaluation 2, a gradation pattern having 32 steps of gradations was outputted at a printing initial stage and after printing 200,000 sheets. The graininess of this gradation pattern was evaluated according to the following evaluation criteria. The granularity was evaluated as follows: performing Fourier transform processing with taking into consideration of MTF (Modulation Transfer Function) correction to the readout value of the gradation pattern by the CCD; and measuring the GI value (Graininess Index) according to human relative visibility to determine the maximum GI value. The smaller the GI value, the better. This GI value is a value described in the Journal of the Imaging Society of Japan 39 (2), 84-93 (2000). The evaluation ranking of Δ, ○ and ◎ indicated below passed examination.

(Evaluation Criteria)

◎: GI value is less than 0.18 at an initial printing stage and after printing 200,000 sheets, and the fluctuation value Δ of GI value is 0.02 or less.

○: GI value is 0.20 or less at an initial printing stage and after printing 200,000 sheets, and the fluctuation value Δ of GI value is 0.02 or less.

Δ: GI value is 0.22 or less at an initial printing stage and after printing 200,000 sheets, and the fluctuation value Δ of GI value is larger than 0.02 and not more than 0.04

X: GI value of either an initial printing stage or after printing 200,000 sheets is larger than 0.22.

TABLE IV

| Developer No. | Initial charging stability | HH environment charging stability after printing 200,000 sheets | HH environment image quality after printing 200,000 sheets (GI value) | Remarks |
|---|---|---|---|---|
| 1 | ○ | ○ | ○ | Present invention |
| 2 | ○ | ◎ | ◎ | Present invention |
| 3 | ○ | ◎ | ◎ | Present invention |
| 4 | ○ | ○ | ○ | Present invention |
| 5 | ○ | ○ | ○ | Present invention |
| 6 | ○ | ○ | ○ | Present invention |
| 7 | ○ | ○ | ○ | Present invention |
| 8 | ○ | ◎ | ◎ | Present invention |
| 9 | ◎ | ◎ | ◎ | Present invention |
| 10 | X | ○ | ○ | Comparative example |
| 11 | ○ | X | X | Comparative example |
| 12 | X | ○ | ○ | Comparative example |
| 13 | ○ | X | X | Comparative example |
| 14 | ○ | X | X | Comparative example |
| 15 | ○ | X | X | Comparative example |

From the above-described evaluation results, it is recognized that the developer of the present invention is excellent in initial charge stability, and excellent in charge stability and image quality in the HH environment, as compared with the developer of the comparative example.

What is claimed is:

1. An electrostatic charge image developer comprising toner particles and carrier particles, wherein the toner particles contain at least silica particles or alumina particles as an external additive;

the carrier particles contain core material particles and a coating resin layer covering a surface of the core particles;

the coating resin layer contains metal oxide particles;

an element measured by XPS (photoelectron spectroscopy) of the carrier particle is at least Si; and a content of Si on a surface of the carrier particle is in the range of 1 to 6 at % with respect to the total elements on the surface of the carrier particle.

2. The electrostatic charge image developer described in claim 1, wherein the toner particles contain a crystalline resin.

3. The electrostatic charge image developer described in claim 1, wherein the metal oxide particles are silica particles.

4. The electrostatic charge image developer described in claim 1, wherein the metal oxide particles have a number average particle diameter in a range of 10 to 50 nm.

* * * * *